US006439394B1

(12) United States Patent
Eiderman et al.

(10) Patent No.: US 6,439,394 B1
(45) Date of Patent: Aug. 27, 2002

(54) SEPARATOR FOR DRY SEPARATION OF POWDERS

(75) Inventors: Boris Eiderman, Jerusalem; Haim Levy, Zur Hadassa; Moshe Voskoboinik, Maaleh Adumim, all of (IL)

(73) Assignee: SorTech Separation Technologies, Ltd., Jerusalem (IL)

( * ) Notice: Subject to any disclaimer, the term of this patent is extended or adjusted under 35 U.S.C. 154(b) by 0 days.

(21) Appl. No.: 09/506,275

(22) Filed: Feb. 17, 2000

(51) Int. Cl.[7] ..... B07B 13/00; B04B 11/08

(52) U.S. Cl. ..... 209/479; 209/488; 209/643; 209/919; 494/58; 494/63

(58) Field of Search ..... 209/479, 480, 209/488, 643, 919; 494/43, 56, 58, 59, 63, 67

(56) References Cited

U.S. PATENT DOCUMENTS

| | | | |
|---|---|---|---|
| 379,133 | A | 3/1888 | Shepard |
| 471,614 | A | 3/1892 | Kerr |
| 489,101 | A | 1/1893 | Seymour |
| 556,567 | A | 3/1896 | Waring |
| 621,306 | A | 3/1899 | Kneeland et al. |

(List continued on next page.)

FOREIGN PATENT DOCUMENTS

| | | |
|---|---|---|
| WO | 99/07476 | 2/1999 |

*Primary Examiner*—Tuan N. Nguyen
(74) *Attorney, Agent, or Firm*—Greenblum & Bernstein, P.L.C.

(57) ABSTRACT

A system for dry separation of powders into at least two fractions including a powder to be separated and a separator including a hollow body rotating about an axis and defining a cavity having a powder engaging surface, the surface of the cavity being a surface of revolution which rotates about the axis, an upper edge of the cavity having a greater diameter than a lower edge, a system controlling the rotation of the body, at least one feeder continuously feeding dry powder into a feeding zone adjacent to the cavity surface near the lower edge, the length of the feeding zone being at least an order of magnitude less than a circumference of the cavity surface of the lower edge, at least one discharge device continuously discharging the powder from the cavity surface, the at least one discharge device including a body arranged along substantially the entire length of the generatrix of the cavity surface and located immediately in front of the feeding zone aligned with the rotation of the cavity surface, a first hopper for collecting a powder fraction consisting of powder particles passing over the upper edge of the cavity surface, and a second hopper for collecting a powder fraction remaining on the cavity surface until the discharge device discharges the remaining powder fraction from the rotating cavity surface into the second hopper.

31 Claims, 14 Drawing Sheets

U.S. PATENT DOCUMENTS

| | | | | |
|---|---|---|---|---|
| 726,948 | A | | 5/1903 | Land |
| 736,976 | A | | 8/1903 | Keiper |
| 1,216,118 | A | | 2/1917 | Hering |
| 1,283,846 | A | | 11/1918 | Mark et al. |
| 1,322,139 | A | | 11/1919 | Schifferle |
| 1,473,421 | A | | 11/1923 | Eccleston |
| 1,594,501 | A | | 8/1926 | Eccleston |
| 1,599,502 | A | | 9/1926 | Thomassen |
| 1,684,870 | A | | 9/1928 | Lewis |
| 1,712,184 | A | | 5/1929 | Wendel |
| 1,750,860 | A | | 3/1930 | Rawlings |
| 1,896,180 | A | | 2/1933 | Lindequist |
| 1,935,547 | A | | 11/1933 | Dryhurst |
| 1,988,500 | A | | 1/1935 | Lack |
| 2,056,888 | A | | 10/1936 | Pecker |
| 2,112,099 | A | | 3/1938 | Ballou et al. |
| 2,230,013 | A | | 1/1941 | Pecker |
| 2,415,210 | A | | 2/1947 | Hoefling |
| 2,472,475 | A | | 6/1949 | Hamilton |
| 2,692,832 | A | | 10/1954 | Hensgen |
| 3,256,993 | A | | 6/1966 | Siepe et al. |
| 3,366,318 | A | | 1/1968 | Steimel |
| 3,507,479 | A | | 4/1970 | Pearl |
| 3,672,646 | A | * | 6/1972 | Burtin ..... 259/151 |
| 3,932,442 | A | | 1/1976 | Salmon et al. |
| 3,941,687 | A | | 3/1976 | Peterson |
| 4,072,266 | A | | 2/1978 | Dietzel |
| 4,608,040 | A | | 8/1986 | Knelson |
| 4,869,786 | A | | 9/1989 | Hanke |
| 5,222,933 | A | | 6/1993 | Knelson et al. |
| 5,300,013 | A | | 4/1994 | Frässdorf et al. |
| 5,372,571 | A | | 12/1994 | Knelson et al. |
| 5,421,806 | A | * | 6/1995 | Knelson et al. ..... 494/37 |
| 5,895,345 | A | | 4/1999 | Knelson |
| 5,934,483 | A | | 8/1999 | Kolacz |
| 6,095,965 | A | * | 8/2000 | Eiderman et al. ..... 494/80 |
| 6,244,446 | B1 | * | 6/2001 | Schmittel ..... 209/157 |

* cited by examiner

SEPARATOR FOR DRY SEPARATION OF POWDERS

BACKGROUND OF THE INVENTION

1. Field of Invention

The present invention relates to separation of dry powders, more particularly it relates to a centrifugal separator for continuous separation of dry powders.

At present, several methods are utilized for dry separation of powders including: air separation, vibration separation using batteries of sieves, and vibro-gravitational separation. In air separation systems, separation is realized by air jets, which remove fine particles out of powder flow and transfer them to a hopper, and heavy particles, which are not carried out by an air jet, fall into another hopper.

2. Description of Related Art

U.S. Pat. No. 5,934,483 to KOLACZ discloses an apparatus of the forced air vortex type for classification of particulate material into a fine portion and a coarse portion, the apparatus comprises a truncated cone shaped upper section having a separating wheel rotating about a substantially vertical axis, a vertically arranged inlet pipe for supplying a particulate material dispersed in an air flow, a conical feed distributor having a tip end directed downwards and arranged concentrically with the inlet pipe and the separating wheel, and a spiral shaped outlet for removal of classified fine material dispersed in air, and a substantially truncated cone shaped lower section, the upper section of which exhibit a secondary air inlet arranged tangentially to the circumference of the lower housing to supply secondary air in a direction concurrently with the direction of rotation of the separating wheel and a second outlet for classified coarse particulate material.

U.S. Pat. No. 4,869,786 to HANKE discloses a process and an air classifier for the separation of classifying material into coarse material and fine material. Known air classifiers suffer from considerable deficiencies with regards to the throughput and the separation efficiency. To avoid this, the device provides for the performance of a separate reclassification, which takes place in the same way as the pre-classification, whilst incorporating mechanical centrifugal rejection of coarse material particles, particularly through the impact ledges of a centrifuge basket.

U.S. Pat. No. 3,941,687 to PETERSON discloses a solids separation system designed for pneumatic separation of pieces of scrap particularly metallic scrap, into light and heavy fractions. The mixture of pieces of scrap is fed into an enclosed separation vessel wherein they fall by gravity into a horizontally directed stream of air blown into and across the separator vessel, whereby the heaviest pieces fall through the air stream into a heavy solids hopper and the lighter materials are carried downstream by the force of the horizontal air stream into a second hopper. A gas outlet port is provided at the top of the vessel thereby imparting an upward velocity vector to the gas. The horizontal velocity of the gas being reduced by expansion, light metal pieces fall out of the influence of the gas stream into the light solids hopper. Means are provided for adjusting the air flow path from the first into the second hopper comprising a pivoted angularly disposed baffle plate defining the rear wall of the first hopper, the surface of which plate also serves to direct solids intercepted thereby into the first hopper.

These methods are energy-consuming due to the necessity of continuous maintenance of air flows. Considerable air volumes become saturated with dust and require special air-cleaning equipment, which makes the facility awkward and expensive.

Separation using sieves has proven to be cheaper and ecologically cleaner. For example, U.S. Pat. No. 3,932,442 to SALMON discloses a process for screening materials as a function of particle size differences by feeding the materials onto one side of a substantially planar screen and vibrating the screen by producing a translational screen oscillation in directions normal to the screen plane and a torsional screen oscillation about an axis normal to the screen plane so that each point of the screen moves in a helical path. Screened material is collected at the other side of the screen and screened retentate is transported by the torsional screen oscillation to an exit port at a location spaced from the axis of torsional oscillation. The process is particularly applicable to shipboard or other mobile use, since the spring stiffness provides good structural support under tilt or side acceleration conditions.

This method is efficient for medium particle sizes in the powder where di>50 $\mu$m. However, at smaller particle sizes, the sieves are soon clogged up. The result is that the process efficiency abruptly decreases. Additionally, elongated particles with one of cross-sections corresponding to the mesh size of the sieve are undesirably allowed pass through the sieves.

Vibro-gravitational separation consists in a motion of particles of different sizes, densities or shapes under the action of vibration along different paths over an inclined concave. Sometimes numerous holes are made in the concave for the passage of compressed air supply, in order to increase the amplitude of particle jumps. This method has proved to be rather efficient for separating seeds and coarse-grain powders. However, its efficiency for powders with a medium particle size below I 00 pm is rather low.

The facility or device suggested in the application PCT/US 98/15797 and International Publication Number WO99/0747, the disclosures of which are expressly incorporated by reference in their entirety herein may be employed as a starting point for the system of the present invention. A separator proposed in this application operates cyclically. The powder is fed to the center of horizontal rotating disk, which spreads it along the entire Internal wall of a rotating cup. Dry powder is separated into two fractions on the internal wall of a rotating cup under the action of friction force and centrifugal force on each particle. Larger particles are allowed to pass over the upper edge of the cup, whereas smaller ones remain on the cup wall. However, to make particles fall down from the cup wall, it is necessary to stop the cup. After it stops, the action of centrifugal force on the particles is stopped, and they fall down into a respective hopper. In this state the facility is ready for the next separation cycle. The efficiency of such a separator has proven to be low, because a large share of operation time is spent on unproductive stops of an inertial cup. Moreover, due to multiple starts and stops, the service life of the engine or motor is shortened, and especially important, the power consumed per unit volume of separated powder is high because an electric engine consumes 2–3-fold amount of energy at the start than in the constant operation mode. Accordingly, improvement is still desired.

SUMMARY OF THE INVENTION

The present invention therefore provides a centrifugal separator for dry separation of powders having a high efficiency and a low power consumption due to its continuous operation. In other words, in the proposed separator the feeding of powder to be separated and the removal of coarse and fine powder fractions after separation take place simultaneously and continuously.

Powder separation occurs on a wall of a cavity of a rotating body. The body rotates around a vertical axis and has a centrally symmetrical cavity open from above and from below. The cavity symmetry axis coincides with the body rotation axis, and the cavity surface is a surface of revolution with circular upper and lower edge's of this cavity, the diameter of the upper circumference being greater that the diameter of the lower circumference.

Powder is fed to a certain zone which is designated a feeding zone and which is positoned adjacent to a lower portion of the cavity surface. The length of this zone is designed to be much less (at least by an order of magnitude) than the length of a separation zone, with the length of the separation zone being approximately 1s. The length (in meters) of the separation zone is determined by the relationship $1s \geqq 1g \times V/Vg$, where 1g is the distance (in meters) between the lower edge of the feeding zone to the upper edge of the cavity surface along the generatrix of the surface of revolution, V is the linear velocity (in meters/second) of the upper edge of cavity surface, and Vg is the velocity (in meters/second) of the coarse powder fraction motion upwards along the generatrix of the surface of revolution.

Each material has its own characteristics, friction coefficient and density. Based upon these characteristics, separation is attainable with the invention. The velocity V depends on the material characteristics of the bowl, such as roughness, diameter, and shape. Thus in the case of separating fly ash, the following data correspond to the following bowl characteristics: the diameter of the upper edge of the bowl is 0.4 meters; the angle of the bowl surface is 40 degrees relative to the vertical bowl axis; and the surface roughness of the bowl surface is 2–3 microns, where 1 micron equals $10^{-6}$ meters.

| mean diameter of coarse fraction particles (microns) | V (m/s) | Vg (m/s) | 1 g (m) | 1 s (m) |
|---|---|---|---|---|
| 60 | 13.0 | 1.75 | 0.7 | 0.6 |
| 80 | 10.0 | 1.00 | 0.7 | 0.07 |
| 100 | 8.5 | 0.74 | 0.7 | 0.8 |

The diameter of course fraction particles can be designated as di>d, where d is the diameter of particles (in microns) according to which particles are separated into two fractions. After the separation zone, in the sense of the body rotation, is located the discharge zone, where a discharge facility or discharge device discharges the powder particles remaining on the cavity surface. Preferably, this device is arranged along the entire generatrix of the surface of revolution.

Separation proceeds as follows. The powder falls on a rotating surface of a cavity having a certain roughness (for example, a roughness of 2–3 microns is adequate for separating fly ash and graphite in a manner depicted in FIGS. 10 and 11). Since the resultant of all the forces acting on powder particles is different for large and small particles, the larger particles move upward and, during the passage of the separation zone from the feeding zone to the discharge zone, pass over the upper edge of the cavity surface and fall into one of the hoppers. The smaller particles remain on the cavity surface until they reach the discharge device, which discharges them into a respective hopper.

A further increase in the facility efficiency can be achieved by arranging several feeding zones and, respectively, separation zones and discharge zones along the cavity surface. Here one of the fractions which is obtained in one of the separation zones can be fed to another separation zone, which will improve the separation quality.

Moreover, powder can be fed to the feeding zone by an appropriately oriented pipe having a nozzle or by utilizing a plurality of rotating disks or rings, or else by a conveyer. These various rotating disks or rings can have a rotation axis which either does or does not coincide with the cavity rotation axis. Further, they can be driven by the same drive as the body or have an independent drive, each of which is independently controllable. Additionally, these disks or rings can be located in a plane perpendicular to the cavity rotation axis, or in some other plane. Moreover, they may be located in the same plane or one under another.

In many of these embodiments, the powder is fed by a pipe to the periphery of the rotating disk or ring and thrown into the feeding zone under the action of the centrifugal force.

One or more discharge devices may be in the form of a flat or round brush adjoining the rotating cavity. The brushes can be adjustably fixed or movable in longitudinal or transverse direction, or may be adapted to rotate around their axes. The discharge device can comprise one brush or several brushes located at various distances form one another. The discharge device can even represent a flexible elastic strip with one of end faces adjoining the cavity surface. Moreover, the discharge device also can represent a pipe with a suction nozzle at the end, with the nozzle being arranged along the generatrix of the surface of revolution, and rarefaction is created in the pipe and in the nozzle. Air flow sucked in by the nozzle tears powder particles off the cavity surface in the discharge zone and directs them into the nozzle and further, by the pipe, into a hopper.

According to one aspect of the invention, there is provided a system for dry separation of powders into at least two fractions including a powder to be separated and a separator comprising a hollow body rotating around a vertical axis, the cavity of the body being often from above and from below and the surface of the cavity represents a surface of revolution with the central axis coinciding the rotation axis of the body, the upper edge of the cavity having a greater diameter than the lower edge, a system controlling the rotation of the body, at least one feeder continuously feeding dry powder into a feeding zone adjacent to the cavity surface near its lower edge, the length of the zone being at least an order of magnitude less than the circumference of the cavity surface in its lower portion, at least one discharge device continuously discharging powder from the cavity surface, which represents a prolonged body arranged along the entire length of the generatrix (the generatrix being a generating line for a body of revolution. In the case of a cone, it is a straight line) of this surface adjoining the surface and located immediately in front of the feeding zone aligned with the rotation of the cavity surface, and at least two hoppers, one of which is intended for powder fraction consisting of powder particles passing over the upper edge of the cavity surface in the course of separation, and the second is intended for powder fraction remaining on the cavity surface until the discharging device discharges it from the rotating surface into the hopper. The slope of the generatrix of the surface of revolution with respect to the vertical may be within the limits from approximately 10° to 45°, and the roughness of the cavity surface may be within approximately 0.01d to 0.2d, where d is the diameter of particles, by which the powder is separated into fractions so that particles with diameters di≦d are found in one fraction, and particles with diameters di≧d—in another.

Moreover n pairs of feeder/discharging device may be uniformly arranged over the cavity surface so that the following relationship is valid: L≧n(1f+1s+1u), where L is the circumference length of the lower edge of the cavity surface, 1f is the feeding zone length, 1s is the separation zone length, 1u is the discharging zone length, the separation zone length being 1s≧1g×V/Vg, where 1g is the distance between the lower edge of the feeding zone to the upper edge of the cavity surface, V is the linear velocity of the upper edge of cavity surface, Vg is the mean velocity of the rise of coarse powder fraction particles along the generatrix of the surface of revolution.

The feeder may consist of a rotating disk and a pipe for feeding powder to this disk, the disk being disposed inside the cavity of the rotating body in the plane perpendicular to the rotation axis of the rotating body, and the outlet of the feeding pipe located above the disk on its periphery.

The disk rotation axis may coincide with cavity rotation axis, and the disk has the same drive as the rotating body. The disk rotation axis may coincide with cavity rotation axis, and the disk has an independent drive. Two or more outlet or feeding pipes may be uniformly arranged above the surface of the disk near its periphery along the its circumference length. The feeder may consist of a rotating flat ring and a pipe for feeding powder to this ring, the ring being disposed inside the cavity of the rotating body in the plane perpendicular to the rotation axis of the cavity, and the rotation axis of the ring coincides with the rotation axis of the cavity, the outlet of the feeding pipe being located above the plane of the ring. At least two such flat rings may be located one above another. At least one such flat ring may be located above the flat disk.

The disk rotation axis may not coincide with the cavity rotation rate, the disk having an independent drive, and there is one outlet of the feeding pipe above its periphery. Two or more the disks may be uniformly arranged along the cavity surface. The disks may be arranged at various heights with respect to the lower edge of the cavity surface. The feeder may consist of a rotating disk and a pipe for feeding powder to this disk, the disk being disposed inside the cavity of the rotating body, and the rotation axis of the disk does not coincide with the rotation axis of the cavity and is not parallel to it, the angle between the rotation plane of the disk and the rotation axis of the cavity being within the interval from approximately 45° to 90°, and the disk has an independent drive, and there is one outlet of the feeding pipe over its periphery.

Moreover, two or more disks may be uniformly arranged along the cavity surface. The feeder may represent a feeding pipe with an outlet fitted with a nozzle feeding powder to the feeding zone. Two or more nozzles may be uniformly arranged along the cavity surface. The feeder may comprise a feeding pipe and a conveyer arranged in the cavity of the rotating body so that the powder on the converer moves along the straight line connecting the rotation axis of the rotating body with the cavity surface, and the outlet of the feeding pipe is located above the conveyer near its end which is nearer to the rotation axis. The plane of powder motion on the conveyor may be perpendicular to the rotation axis of the cavity. The angle between the plane of powder motion on the conveyer and the rotation axis of the cavity may be within the range of approximately 45° to 90°. The space in front of the discharge device in the sense of rotation may be surrounded along the entire length of the discharge device by a shell-powder concentrator, which does not adjoin the cavity surface.

The discharge device may represent at least one flexible elastic strip adjoining the cavity surface with the end face of its longer side and arranged along the entire length of the generatrix of the surface of revolution at an angle from approximately 0° to 30° to the latter. The discharge device may represent at least one flat brush arranged along the entire length of the generatrix of the surface of revolution at an angle from approximately 0° to 30° to the generatrix. Several the brushes may be assembled into a battery and arranged parallel to one another with an interval equal or exceeding the width of one brush. The discharge device may represent at least one rotating circular brush having an independent drive and arranged along the entire length of the generatrix of the surface of revolution at an angle to the generatrix. The angle may be within the interval from approximately 0° to ±30°. The discharge device may represent a conveyer (belt, apron or flight conveyor) with external surfaces of conveying planes made in the form of a brush, which is arranged along the entire length of the generatrix of the surface of revolution. The separator may be fitted with an additional rotating disk whose rotating axis coincides with the rotation axis of the cavity and which is located under the lower level of the surface of revolution.

According to another aspect of the invention, there is provided a system for the dry separation of powders into at least two fractions including a powder to be separated and a separator comprising, a hollow body rotating about a vertical axis, the cavity of the body being open from above and from below and the surface of the cavity representing a surface of revolution with the central axis coinciding with the rotation axis of the body, the upper edge of the cavity having a greater diameter than its lower edge, a system controlling the rotation of the body, at least one feeder continuously feeding dry powder into a feeding zone adjacent to the cavity surface near its lower edge, the length of the zone being at least an order of magnitude less than the circumference of the cavity surface in its lower portion, at least one discharge device continuously removing powder from the cavity surface, which represents an air suction nozzle arranged along the entiro generatrix of the surface of revolution, and at least two hoppers, one of which is intended for powder fraction consisting of powder particles passing over the upper edge of the cavity surface in the course of separation, and the second is intended for powder fraction remaining on the cavity surface until it is sucked in by the nozzle.

According to another aspect of the invention, there is provided a system for dry separation of powders into at least two fractions including a powder to be separated and a separator comprising, a hollow body rotating about an axis and defining a cavity having a powder engaging surface, the surface of the cavity being a surface of revolution which rotates about the axis, an upper edge of the cavity having a greater diameter than a lower edge, a system controlling the rotation of the body, at least one feeder continuously feeding dry powder into a feeding zone adjacent to the cavity surface near the lower edge, the length of the feeding zone being at least an order of magnitude less than a circumference of the cavity surface of the lower edge, at least one discharge device continuously discharging the powder from the cavity surface, the at least one discharge device comprising a body arranged along substantially the entire length of the generatrix of the cavity surface and located immediately in front of the feeding zone aligned with the rotation of the cavity surface, a first hopper for collecting a powder fraction consisting of powder particles passing over the upper edge of the cavity surface, and a second hopper for collecting a powder fraction remaining on the cavity surface until the discharge device discharges the remaining powder fraction from the rotating cavity surface into the second hopper.

In some embodiments, the present invention relates to a combination of the separator as disclosed herein, in combination with a mixture of dry powders to be separated.

The invention provides system for dry separation of powders into at least two fractions comprising:

a) a hollow body rotatable about a vertical axis of rotation, the body having a cavity defined by a surface having an axis of rotation having a central axis coinciding with the axis of rotation of the hollow body, the surface defining the cavity having an upper edge having a greater diameter than a lower edge of the surface defining the cavity;

b) a system controlling the rotation of the body;

c) at least one feeder constructed and arranged to substantially continuously feed dry powder into a feeding zone adjacent to the cavity surface near its lower edge, the length of the zone being at least an order of magnitude less than the circumference of the cavity surface in its lower portion;

d) at least one discharge device constructed and arranged to substantially continuously remove powder from the cavity surface, e) at least two hoppers, one of which is constructed and arranged to receive a powder fraction comprising powder particles passing over the upper edge of the cavity surface in the course of separation, and the second of which is constructed and arranged to receive a powder fraction remaining on the cavity surface essentially until the discharging device removes it from the rotating surface into the hopper.

The discharge device can comprise an enlongated body arranged along a length of the generatrix of the surface defining the cavity and located immediately in front of the feeding zone.

The slope of the generatrix of the surface defining the cavity with respect to the vertical may be within the limits from about 10° to about 45° and the roughness of the cavity surface is within about 00.1d to about 0.2d, where d is the diameter of particles, by which the powder is separated into fractions so that particles with diameters di≦d are found in one fraction, and particles with diameter di≧d—in another.

In some embodiments, n pairs feeder/discharging device are uniformly arranged over the cavity surface so that the following relationship is valid: L≧n(1f+1s+1u), where L is the circumference length of the lower edge of the surface, 1f is the feeding zone length, 1s is the separation zone length, 1u is the unloading zone length, the separation zone length being 1s≧1g×/Vg, where 1g is the distance between the lower edge of the feed zone to the upper edge of the cavity surface, V Is the linear velocity of the upper edge of cavity surface, Vg is the mean velocity of the rise of coarse powder fraction particles along the genratrix of the surface of revolution.

In some embodiments, the feeder comprises a rotating disk and a pipe for feeding powder to the disk, the disk being disposed inside the cavity of the rotating body in a plane perpendicular to the rotation axis of the rotating body, and the outlet of the feeding pipe located above the disk on its periphery.

In some embodiments a disk rotation axis coincides with rotation axis of the surface defining the cavity, and the disk has the same drive as the rotating body.

In some embodiments, a disk rotation axis coincides with surface defining the cavity, and the disk has an independent drive.

In some embodiments, two or more outlets of feeding pipes are uniformly arranged above a surface of the disk near its periphery along the its circumference length.

In some embodiments, the feeder comprises a rotating flat ring and a pipe for feeding powder to this ring, the ring being disposed inside the cavity of the rotating body in the plane perpendicular to the rotation axis of the cavity, and the rotation axis of the ring coincides with the rotation axis of the cavity, the outlet of the feeding pipe being located above the plane of the ring.

In some embodiments at least two flat rings are located one above another. At least one such flat ring may be located above the flat disk.

In some embodiments, the disk rotation axis does not coincide with the cavity rotation rate, the disk having an independent drive, and there is one outlet of the feeding pipe above its periphery.

In some embodiments two or more disks are uniformly arranged along a cavity surface.

The disks may be arranged at various heights with respect to the lower edge of the cavity surface.

The feeder may comprise a rotating disk and a pipe for feeding powder to the disk, the disk being disposed inside the cavity of the rotating body, and the rotation axis of the disk does not coincide with the rotation axis of the cavity and is not parallel to it, the angle between the rotation plane of the disk and the rotation axis of the cavity being within the interval from about 45° to about 90°, and the disk has an independent drive, and the feeding pipe comprises outlet.

Two or more disks may be uniformly arranged along a cavity surface.

The feeder may comprise feeding pipe with an outlet fitted with a nozzle feeding powder to the feeding zone.

Two or more nozzles may be uniformly arranged along the cavity surface.

The feeder may comprise a feeding pipe and a conveyer arranged in the cavity of the rotating body so that the powder on the conveyer moves along the straight line connecting the rotation axis of the rotating body with the cavity surface, and the outlet of the feeding pipe is located above the conveyer near its end which is nearer to the rotation axis.

The powder may be caused to move in a plane of powder motion on the conveyor is perpendicular to the rotation axis of the cavity.

The angle between the plane of powder motion on the conveyer and the axis of rotation of the cavity may be within a range from about 45° to about 90°.

In some embodiments, a space in front of the discharge device with respect to a direction of relative rotation is surrounded substantially along the entire length of the discharge device by a shell/powder concentrator, which does not adjoin the cavity surface.

The discharge device may comprise at least one flexible elastic strip adjoining the cavity surface with the end face of its longer side and arranged along the entire length of the generatrix of the surface of revolution at an angle form about 0° to about 30° (to the generatrix).

The discharge device may comprise at least one flat brush arranged along the entire length of the generatrix of the surface of revolution at an angle from 0° to 30° to the generatrix. The brushes may be assembled into a battery and arranged parallel to one another with an interval equal or exceeding the width of one brush.

The discharge device may comprise at least one rotating circular brush having an independent drive and arranged along the entire length of the generatrix of the surface of revolution at an angle to the generatrix and the angle is within the interval from about 0° to ± about 30°.

The discharge device can comprise a member selected from a conveyer, a belt, an apron or flight conveyer or combinations thereof comprising external surfaces of conveying planes in the form of a brush, which is arranged along essentially the entire length of the generatrix of the surface of revolution.

The separator can comprise a rotating disk whose rotating axis coincides with the rotation axis of the surface defining the cavity and which is located under the lower level of the surface of revolution.

The invention also provides a system for dry separation of powders into at least two fractions including a powder to be separated and a separator comprising:

a) a hollow body rotatable about a vertical axis, the hollow body having a cavity of open from above and from below and the cavity comprising a surface of revolution having a central axis coinciding with the rotation axis of the body, the upper edge of the cavity having a greater diameter than its lower edge.

b) a system rotating the body;

c) at least one feeder continuously feeding dry powder into a feeding zone adjacent to the cavity surface near its lower edge, the length of the zone being at least an order of magnitude less than a circumference of the cavity surface in its lower portion;

d) at least one discharge device constructed and arranged to essentially continuously remove powder from a cavity surface, comprising a suction nozzle arranged along essentially the entire generatrix of the surface of revolution;

e) at least two hoppers, one of which is constructed and arranged to receive a powder fraction comprising powder particles passing over the upper edge of the cavity surface in the course of separation, and the second is intended for powder fraction remaining on the cavity surface until being suctioned by the nozzle.

In other embodiments, the invention provides a system for dry separation of powders into at least two fractions including the system comprising a powder to be separated and a separator comprising:

a hollow body rotating about an axis and defining a cavity having a powder engaging surface, the surface of the cavity being a surface of revolution which rotates about the axis, an upper edge of the cavity having a greater diameter than a lower edge;

a system controlling the rotation of the body;

at least one feeder continuously feeding dry powder into a feeding zone adjacent to the cavity surface near the lower edge, the length of the feeding zone being at least an order of magnitude less than a circumference of the cavity surface of the lower edge;

at least one discharge device continuously discharging the powder from the cavity surface, the at least one discharge device comprising a body arranged along substantially the entire length of the generatrix of the cavity surface and located immediately in front of the feeding zone aligned with the rotation of the cavity surface;

a first hopper for collecting a powder fraction consisting of powder particles passing over the upper edge of the cavity surface;

a second hopper for collecting a powder fraction remaining on the cavity surface until the discharge device discharges the remaining powder fraction from the rotating cavity surface into second hopper.

DETAILED DESCRIPTION OF PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
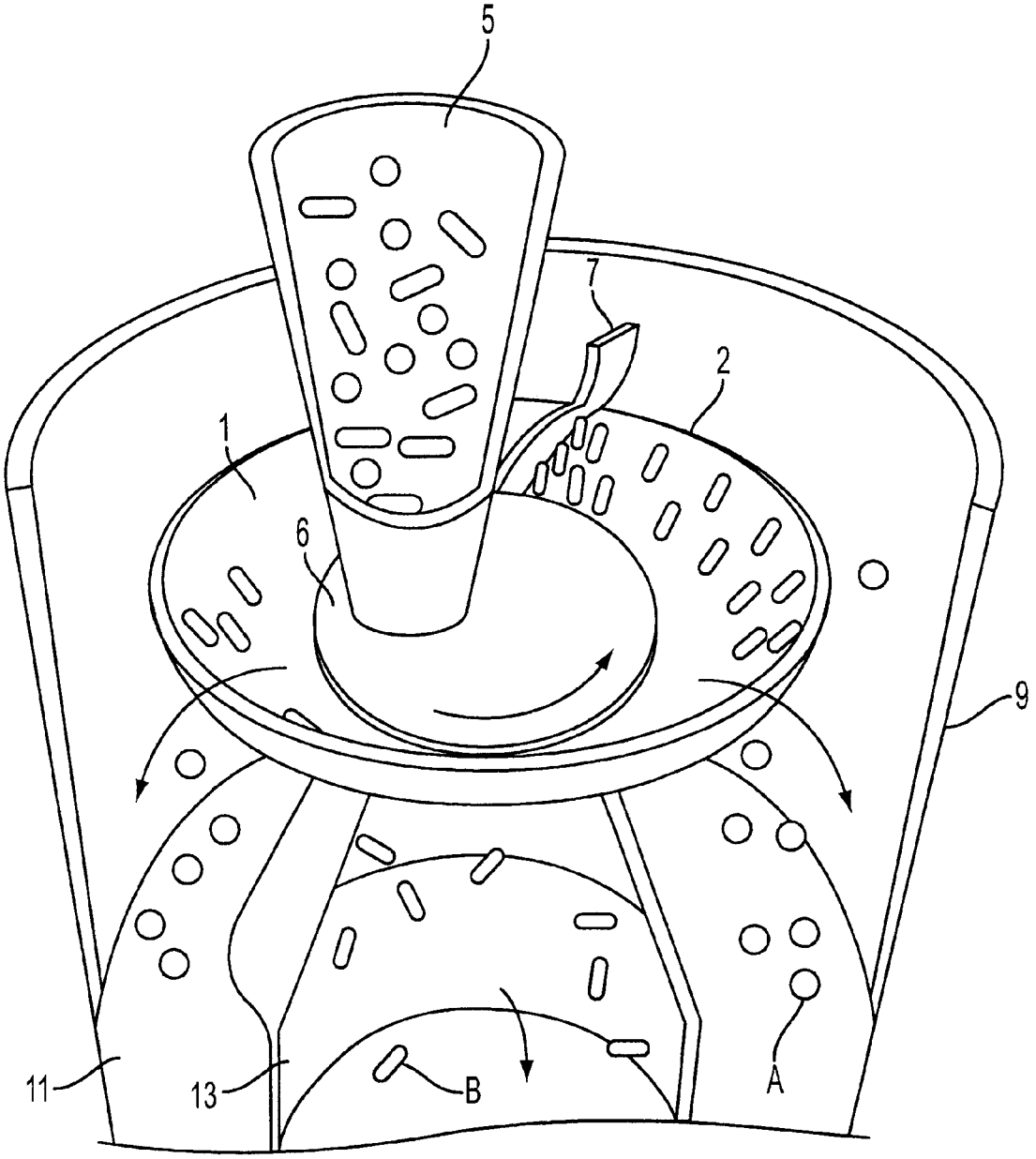
FIG. 1 shows one embodiment of a separator for dry separation of powders.

FIG. 1 shows a simple embodiment of a separator for dry separation of powders. A powder representing a mixture of spherical particles ("A" type particles) and cylindrical particles ("B" type particles) is poured, fed, or otherwise delivered etc., through feeding pipe or conduit 5 into the separator. The particles (e.g., mixture of A and B particles) are fed onto disk 6. In operation, the separator provides that disk 6 is rotating when the powder is fed onto its throwing surface. By virtue of the disk 6 rotation at a specific or desired velocity, the powder mixture is caused to be thrown outwards against surface 1 of rotating bowl 50. Thus, for example, the velocity of the outer edge of disk 6 ($V_{disk}$) may be in the range of $2Vs>V_{disk}>Vs$, where Vs is the velocity of surface 1 near the feeding zone.

A zone 54 (see FIG. 3*a*) is herein designated as a feeding zone and which is located above the rotating bowl surface 1, i.e., zone 54 represents the zone between where the powder leaves the disk 6 and where it contacts surface 1. The powder or mixture contacts surface 1 which is rotating (i.e., since bowl 50 is rotating) and due to the frictional engagement or interaction between the powder and the surface 1, the powder is caused to rotate in the same direction as the bowl 50.

The spherical particles A are caused to be thrown up and over the edge 2 of bowl 50 or surface 1. The roughness of surface 1 should be such that the friction coefficient of the fine/elongated particles (B particles) will be high enough so as to be retained on the surface 1. Moreover, the friction coefficient of the coarse/spherical particles (A particles) is sufficiently low so as to allow them to not be retained by surface 1 such that they roll over the edge 2. In this regard, the bowl is preferably made of stainless steel and surface 1 may preferably comprise coating. This coating may, for example, be a hard surface layer of Aluminum Oxide ($Al_2O_3$) or other ceramic coatings.

The spherical particles A which flow over edge 2 are then directed via enclosure section or hopper 11, which in this embodiment is formed between separator outer wall or body 9 and the inner workings of the separator. As will be described later on in other embodiments, these particles may then be channeled or conveyed for further processing. A zone designated as zone 56 (see FIG. 3*a*) represents a separation zone where the spherical particles ("A" particles) leave the surface 1 after initially contacting the surface 1. This zone is the zone where separation takes place and extends from the feeding zone 54 to the discharge zone 58. As discussed above, this length may be 1s (see for example, FIG. 3*b*). The cylindrical particles B which remain on surface 1 rotate with the bowl 50 on surface 1 and remain thereon until they contact or interact with the discharge device 7. In this regard, the separator includes a discharge device having a bracket end 20 attached to a static or stationary part of the separator, here the outer wall or body 9. Discharge device 7 also has a holder end 19 (see FIGS. 5*a–d*). Holder end 19 is held rigid by bracket 20 and has a brush 17 or strip 15. This brush 17 or strip 15 is designed to rub against surface 1 and acts to sweep surface 1. Thus, when the surface 1 delivers the cylindrical particles B to the discharge device 7, they are prevented from traveling any further in the direction of the bowl rotation. That is, they are swept off the surface by virtue of a reduction in the frictional engagement between the cylindrical particles B and the surface 1, and as a result their velocity decreases. At this point, the force of gravity causes the cylindrical particles B to move inwards towards the center axis of the rotating bowl. However, since the bowl has an open center area (see FIG. 2), the cylindrical particles pass through this open area to an inner enclosure, channel, or hopper 13. Again, as with the channel or hopper 11 above, the particles may then be conveyed away for further processing.

Discharge device 7 should extend across substantially the entire surface 1 of rotating bowl 50. In each of FIGS. 1 and 2*a–b,* the discharge device includes brush 17 and extends between rotating disk 6 and rotating bowl 50 via surface 1. Moreover, although a single discharge 7 device is shown, nevertheless, more than one are certainly contemplated, as will be seen with respect to other embodiments. A zone designated as zone 58 (see FIG. 3*a*) represents a discharge zone where the cylindrical particles are swept off the surface 1 traveling with surface 1.

It should be noted at this point that the designation of the powder particles as spherical A type particles and cylindrical B type particles is used merely to illustrate the basic operation of the device. That is, a true designation of the different particles is one where the device separates two different types of particles based upon their characteristic ability to frictionally engage the surface 1. In this regard, the particles need not be spherical and/or cylindrical. Rather, they are distinguished by their different frictional interaction with the surface 1 based upon, for example, their shape, size, and density. The importance of the invention lies in the separation of at least one type of particle from a mixture of two or more types of particles. As will be described below, this distinguishing characteristic may be on the basis of particle diameter when the mixture is essentially one powdered substance which is made up of different size particles of the same substance. With this in mind, the invention provides for the distinguishing or the separation of "fine fraction" particles which would act in a manner similar to that shown with respect to the cylindrical B particles (i.e., they are not thrown off the surface, but remain thereon until being brushed off), and "coarse fraction" particles which would act in a similar to that shown with respect to the spherical A particles (i.e, get thrown over edge 2).

As discussed above, the discharge device 7 may be a brush 17 which is static and has brush ends engaging the surface 1 in a sweeping action (based upon relative movement between the brush and the bowl). Brush 17 operates in discharge zone 58 (see FIG. 3*a*) where it sweeps off the fine fraction particles. Moreover, the brush may be oriented at a angle (see FIG. 1) such that a top portion of the brush which engages surface 1 contacts particles traveling on surface 1 before a bottom portion the brush 17. This angle can be optimized to improve the efficiency of the sweeping action on surface 1.

Figure 2A:
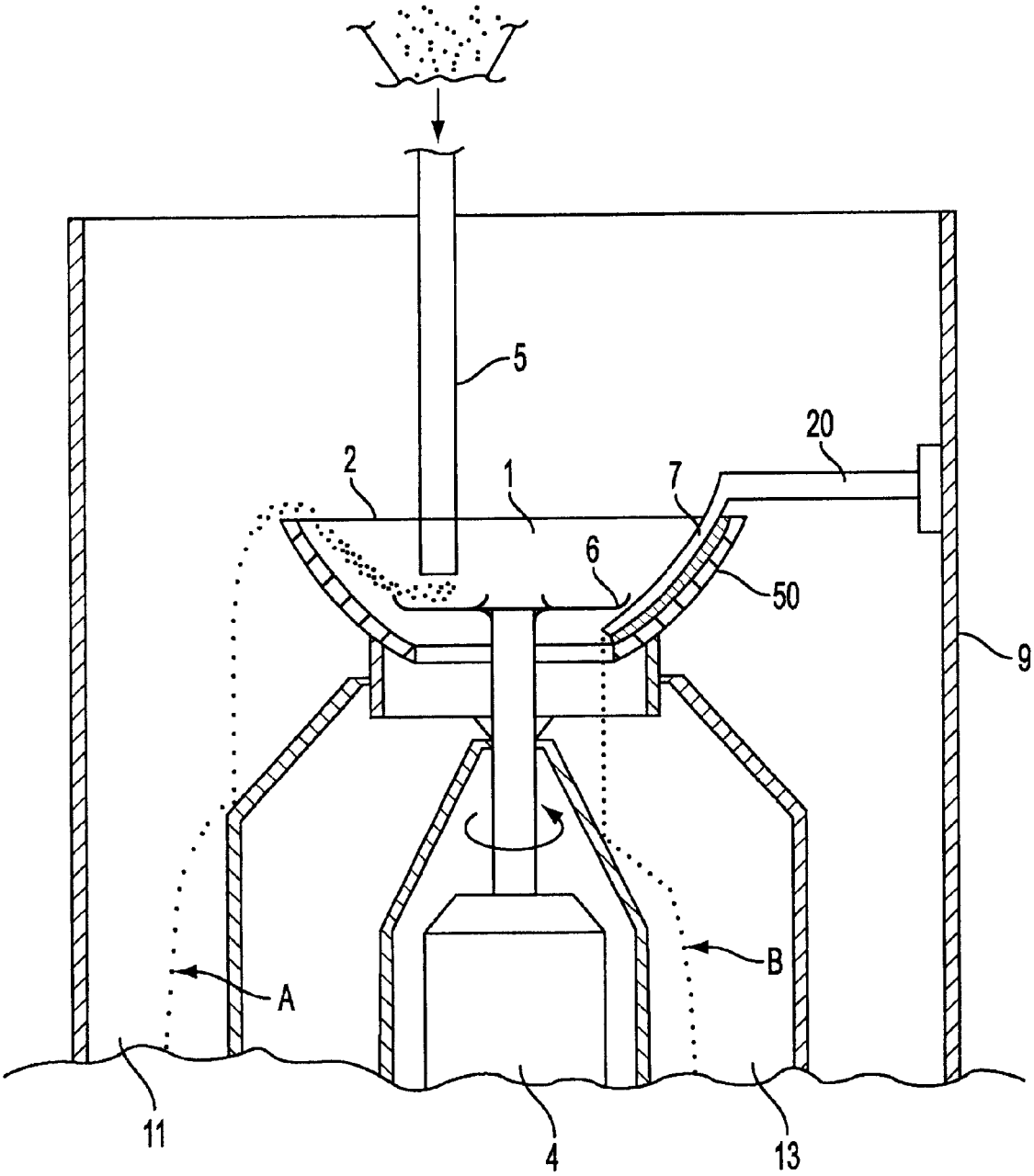
FIG. 2*a* shows a partial cross-section view of an embodiment of a separator similar to that shown in FIG. 1 except that it utilizes a curved bowl.

FIG. 2*a* shows one embodiment of the separator which operates in a similar manner to that discussed with respect to FIG. 1. Here the interaction between the discharge device 7 and the surface 1 can be clearly seen. The separator includes a drive 4 in the form of a motor which can be any conventional motor, and is preferably and electric motor. Moreover, motor 4 rotates a shaft connected to each of the bowl 50 and disk 6. Alternatively, motor 4 may rotate the disk 6 and bowl 50 independently so that each of their rotation speeds may be controlled and varied. This can be accomplished, for example, using a transmission attached to the motor or by the use of two motors. Disk 6 may take on a variety of configurations for efficiently delivering or feed in the powder to the surface 1, as will be seen in later embodiments. In this embodiment, disk 6 includes an upper surface which deflects the powder outwards against surface 1. In this regard, disk 6 includes deflection projections which are inwardly disposed to prevent the powder from settling centrally. Disk 6 also has a raised deflection outer edge which causes the powder to follow a sloping upward course toward the surface 1. The size and shape of this edge may be varied in an effort to optimize the even distribution of the powder onto surface 1. Various internal deflection walls may also be provided to help guide the separated particles into the desired hoppers. This aspect of the invention will be further described later on in other embodiments.

In the embodiment of FIG. 2*a*both the bowl 50 and the disk 6 are connected to the shaft extending from the motor 4. As can be seen by a arrow around the shaft connecting the motor 4 to the disk 6 and bowl 50, the bowl 50 and disk 6 will rotate together. However, body 9, bracket 20, and discharge device 7 do not rotate, but instead are static.

Figure 2B:
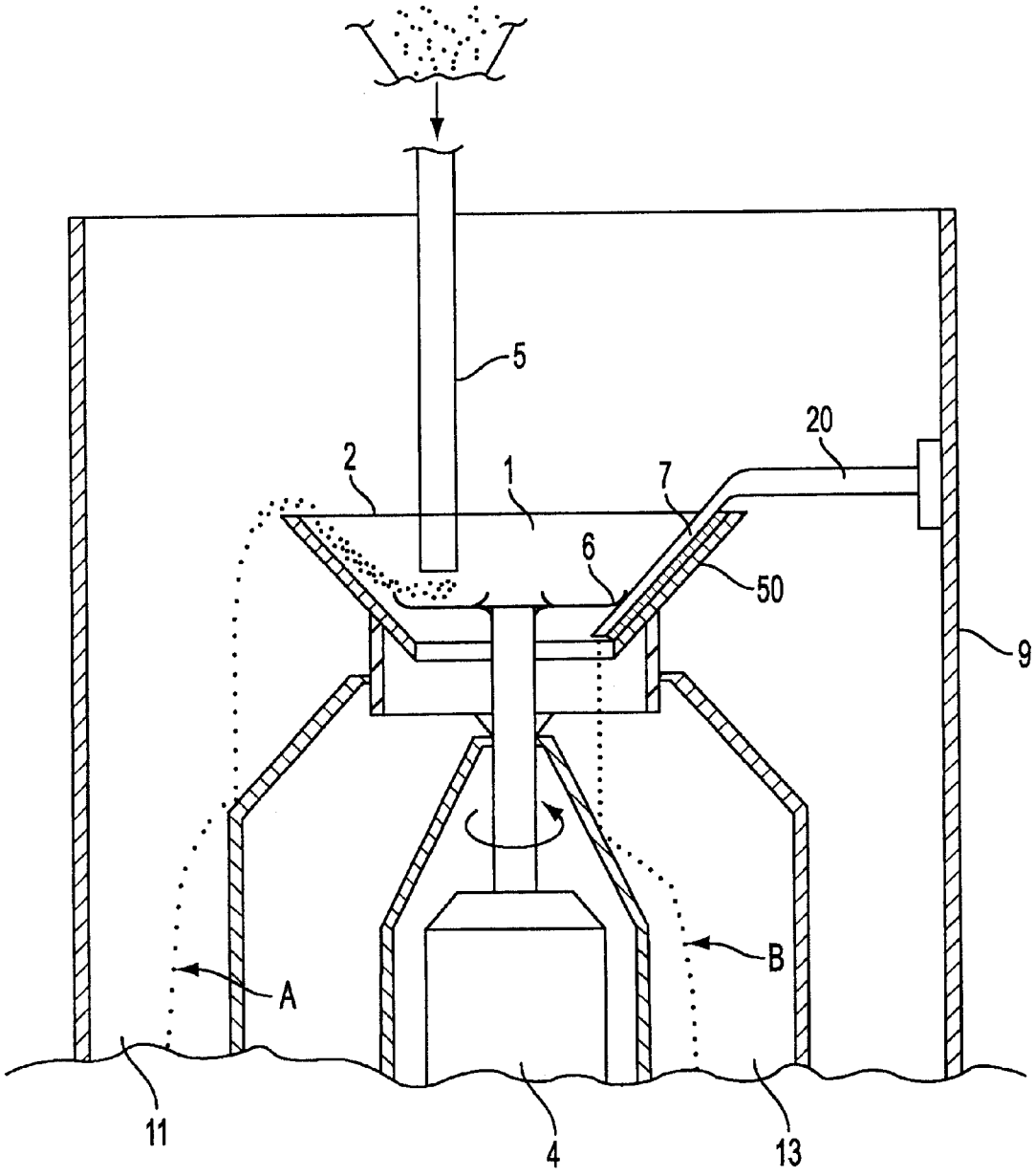
FIG. 2*b* shows a partial cross-section view of an embodiment of a separator similar to that shown in FIG. 1 using a conical bowl.
Figure 4A:
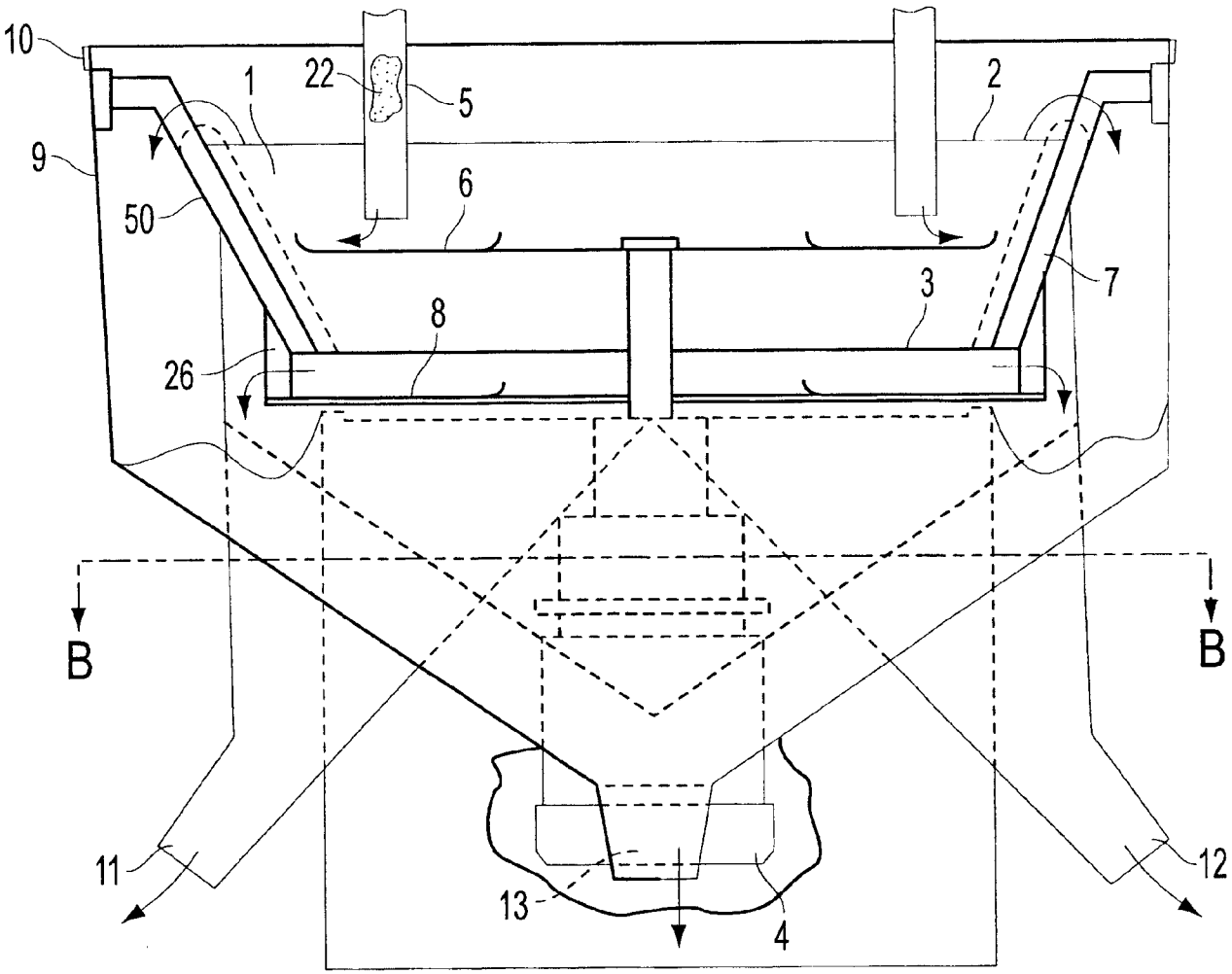
FIG. 4*a* shows a side view of another embodiment of a separator for dry separation of powders.

It should be noted that the invention also contemplates bowls which are essentially flat (i.e., conical as in see FIGS. 2*b* & 4*a,* for example). In such an embodiment, the discharge device may also be flat so that it has essentially the same profile shape of surface 1. Moreover, other bowl configurations are contemplated such as those which have a wavy or sinusoidal profile (not shown). Moreover, FIG. 2*a* shows a bowl profile which is essentially concave, however, a convex profile is also contemplated.

Figure 3A:
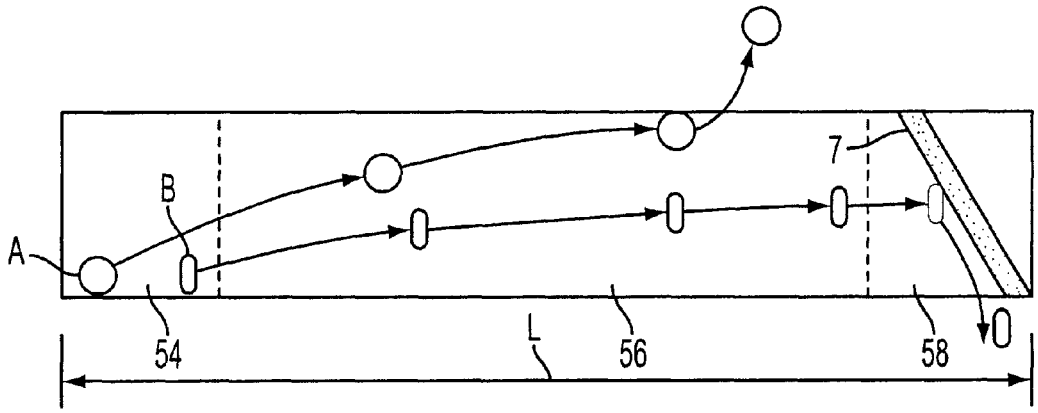
FIG. 3*a* shows an interaction between a separating surface and two different types of powder particles designated by geometry and or shape.

FIG. 3*a* shows the interaction of the particles with the zones 54, 56, and 58. It should be understood, that the brush 17 does not interact with either zones 54 and 56. Zone 54, as described above, represents the space between rotating disk 6 and where the initial powder is fed onto surface 1. Zone 56 is a zone which is some distance from where the A particles leave the surface 1 over upper edge 2, these particles being separated from the remaining B particles.

In this regard, L represents a distance (in meters) which is traveled by the particles from an initial point when the powder is fed to surface 1 to a point where the B particles get swept off the surface 1. Thus looking from left to right in FIG. 3*a,* it will be seen that the powder in the form of particles A and B is fed to surface 1 via zone 54. At this point both particle types are mixed together. However, upon interacting with surface 1, each particle type begins to follow a different course. The A particles interact briefly with surface 1 and are separated from the B particles within separation zone 56. As can be seen from the Figure, the A particles never reach discharge zone 58 because they do not remain in contact with surface 1 long enough to be carried by surface 1 to the brush 17 or discharge device 7. However, the B particles remain on surface 1 and/or continue to interact with surface 1 for a greater distance. As a result they are conveyed with moving surface 1 towards the discharge device 7. The point where these B particles contact the discharge device 7 is designated as zone 58. As can be seen from the figure only the B particles have remained on the surface 1 long enough to reached this zone. At this point, by virtue of the discharge device 7 rubbing against surface 1, the B particles will collide with the discharge device and as a result they are caused to separate from moving surface 1. In essence, the B particles are swept off moving surface 1 because they collide with the brush 17 and are not allowed to continue to move with surface 1. Thus the B particles having lost a velocity which was sufficient to maintain their position on the surface, are now acted upon gravity in combination with a deflection angle generated by the brush 17 or discharge device. As a result, the B particles flow inwards towards the center of the bowl 50 where they are then collected in hopper 13 (see FIGS. 1 and 2*a–b*).

Figure 4B:
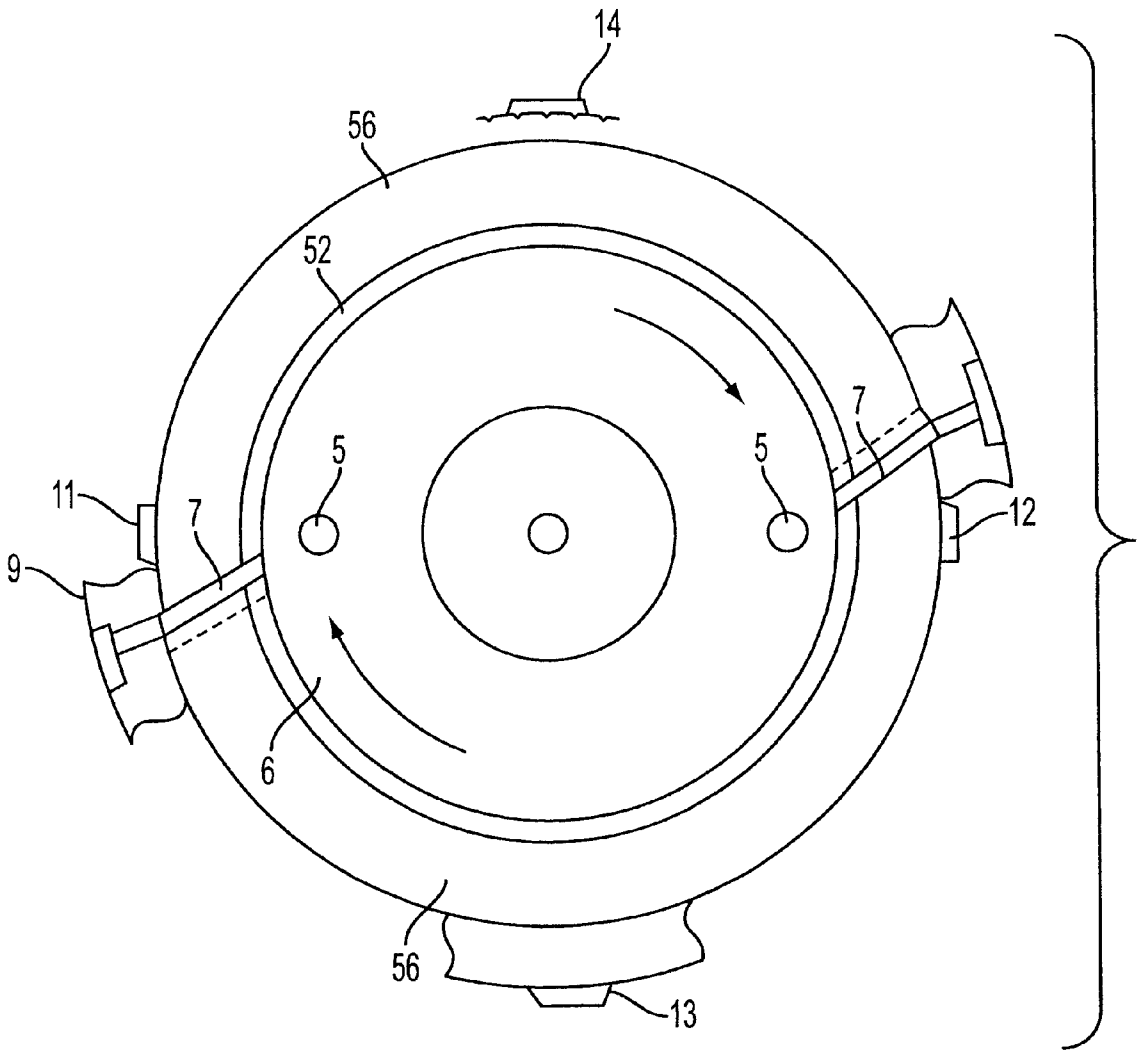
FIG. 4*b* shows a top view of the embodiment shown in FIG. 4*a;*

FIGS. 4*a* and 4*b* shows another embodiment of a separator in which like components have like reference numbers. The separator has rotating body 50 with a cavity 52 open from above and from below with a surface 1 of the cavity 52 being a surface of revolution, namely, a surface of a truncated cone. In this embodiment, a diameter of the upper edge 2 of the surface 1 is preferably approximately 1000 mm or 1 meter, with the diameter of the lower edge 3 being approximately 800 mm. The separator includes a drive 4 with may preferably have a power of approximately 1.5 kW.

This embodiment uses for example, two feeders, each of them having the form of a powder feeding pipe 5 similar to those described above. Each pipe 5 has an outlet end which is located above a peripheral portion of rotating disk 6. The outlets of feeding pipes 5 are preferably located along the diameter of the disk 6 at its opposite ends (see FIG. 4*b*). Moreover, this embodiment utilizes two discharge devices 7 which may similarly be located opposite one another.

An additional rotating disk 8 is provided below disk 6 in order to deflect the B particles to hopper 11. Disk 8 may have a similar design to disk 6 in regards to using centrally disposed deflection protrusions. However, the outer edge deflection would not be required as the B particles are to be conveyed essentially horizontally. Moreover, as discussed above, each of disk 6, disk 8 and bowl 50 may be rotated on a single shaft or arbor. Alternatively, each may be individually rotated by telescoping shafts which are each rotated at different speeds, and which are preferably individually controllable. Again, this may be accomplished with a transmission unit and/or with separate motors and controls.

The separator preferably is a self contained separating system in the form of a seal enclosure to prevent the escape of powder. In this respect, it preferably has a body portion in the form of an enclosure shell body 9 and includes a lid 10 which is removable or which can be open easily to facilitate maintaining the separator and/or for cleaning the separator.

The body 9 preferably includes symmetrically arranged hoppers 11 and 12 for collecting the fraction (for example, B particles) discharged by discharge devices 7 from the surface 1. In this regard, hoppers 11 and 12 may be arranged on opposite sides of the separator. Similarly, separator may utilize symmetrically arranged hoppers 13 and 14 for the fraction passing over the upper edge 2 of the surface 1 (for example, A particles) in separation zones 56 in the process of separation.

While preferred embodiments of the invention employ a brush, other discharge devices could be employed. These include, an elastic strip(s) or wiper blade(s). Additionally, a scraper type device may be employed. The scraper could be made of a hard material which extends across the entire generatrix of surface 1 and located a small distance from it, e.g., approximately 10 to 20d.

Figure 5B:
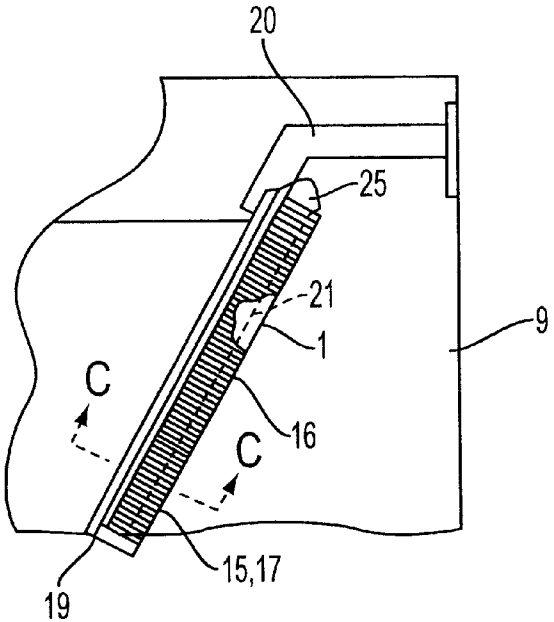
FIGS. 5*a*–5*b* shows partial views of the discharge device interacting with the rotating surface.
Figure 5D:
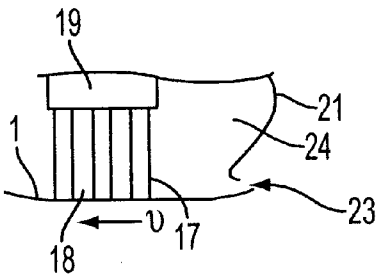
FIGS. 5*c*–5*d* shows end views of the discharge device in the form of an elastic strip or a brush, and shows the location of a shell, in the form of a powder concentrator, with respect to the discharge device, the discharge device is also shown in the form of a battery of brushes.
Figure 5A:
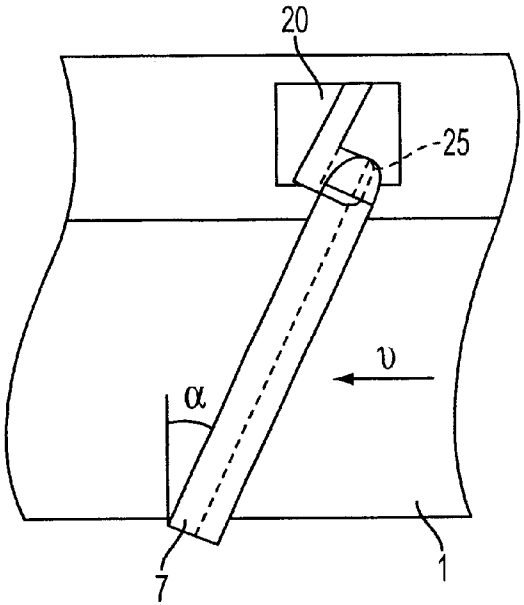

As shown in FIGS. 5*a–b,* the discharge device 7 can be in the form of a flat brush 17 (or one having a profile similar to the profile of surface 1) fixed in a holder portion 19 so that the ends of the brush bristles adjoin, contact, sweep, and/or otherwise engage the rotating conical surface 1. Alternatively, instead of a brush, an elastic strip 15, or a plurality of elastic strips, can be fixed in the same position. These may resemble a wiper type device in design (as for example is used on car windshields). Moreover, the strips may be made, for instance, of a fluoropolymer sheet and have an approximate thickness of 0.8 mm. In such a design, an edge of the one or more strips would rub against surface 1 with the end face of its longer side 16. These strips may be in the form of blades which are made from flexible material which can deflect somewhat when placed in contact with surface 1 and should have good wear characteristics so that they last a long time since they are held with some pressure continuously against the surface 1.

Figure 5C:
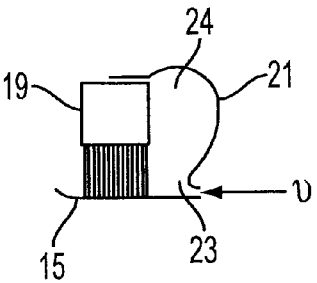

As discussed above, the brush 17 or the strip 15 is preferably arranged along the entire length of the generatrix of the surface 1 of revolution and at an angle $\alpha$ of approximately 15° to the latter. Moreover, elastic strip(s) 15 or brush(s) 17 can be assembled and/or oriented in batteries of several strips (brushes) which are arranged parallel to each other as shown in FIGS. 5*c–d.* Strips 15 or brushes 17 may be arranged close to each other (e.g., tight spacing, FIG. 5*c*) or with an interval or space 18 between the brushes 17 or strips 15 (e.g., loose spacing, FIG. 5*d*). The strips 15 or brushes 17 may be fixed in a holder 19 which is mounted on the body 9 by a bracket 20. Moreover, this attachment is preferably adjustable and removable to facilitate changing out the brushes as well as to adjust the amount of force the brushes or strips exert on surface 1. To assist the efficiency of the brush 17 or strip 15 in arresting the velocity of, for example, the B particles (note the "v" designates a traveling velocity and/or direction of surface 1), the discharge device 7 may include a shell 21 which defines an interior space 24 in front of the discharge device 7. Shell 21 is preferably attached to the holder 19 at a convenient surface (see FIG 5*c*) and extends the entire length of the brush or strip. Moreover, shell 21 functions as a powder concentrator and does not adjoin or contact the surface 1. Instead it has an edge which is separated from surface 1 by a distance 23, this distance being great enough to allow, for example, the B particles to reach the brush 17 or the strip 15.

Figure 3B:
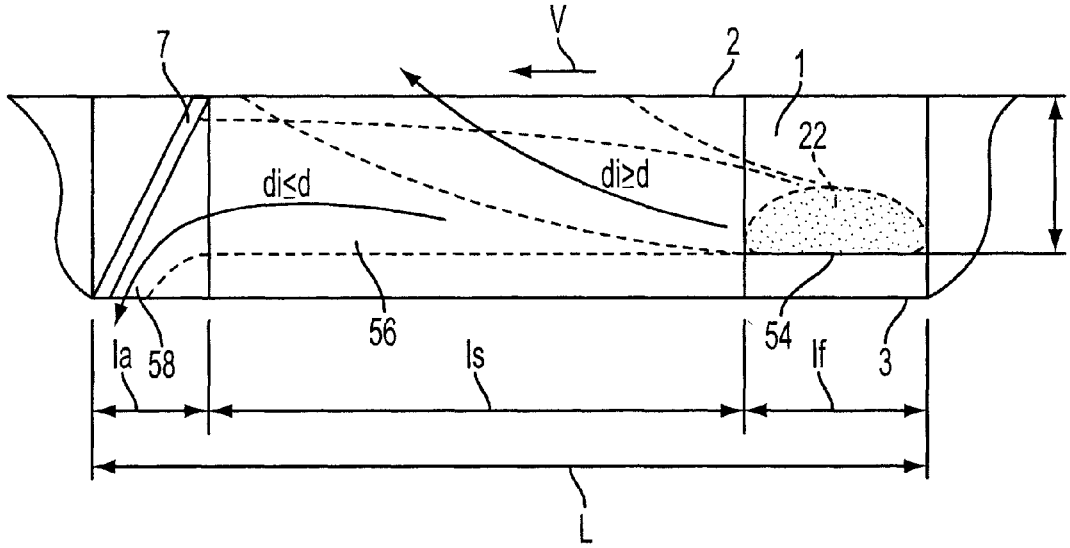
FIG. 3*b* shows an interaction between a separating surface and two different types of powder particles designated by diameter d (by size)

FIG. 3*b* illustrates the operation of the separator shown in FIGS. 4*a–b.* In FIG. 3*b,* is shown a development of a half of the surface 1 of the cavity 52. A powder particle(s) 22 is fed by feeding pipe(s) 5 to the periphery of a rotating disk 6 which may be located at a distance of approximate 150 mm below the upper edge 2 of the rotating surface 1. The gap between the disk 6 edge and the surface 1 is preferably in the range of approximately 40–45 mm. Under the action of a centrifugal force, the powder is thrown into feeding zone 54. The feeding zone 54 may be, for example, approximately 200 mm long. After falling onto the surface 1, particles of powder 22 move outwards under the action of centrifugal force but also resist movement due to a frictional force (resulting from contact with surface 1) along different paths in separation zones 56. Thus, coarse fraction particles having diameters $di \geqq d$, where d is the diameter of particles an forms the basis of which separation into two fractions accomplished, pass over the upper edge 2 of the surface 1 in separation zone 56, and then fall into hoppers 13 and 14.

Fine fraction particles have diameters $di \leqq d$ and therefore remain on the rough surface 1 due to frictional engagement with surface 1, until they reach, together with the surface 1, the discharge zones 58, where discharge devices 7 (e.g., flat brush 17 or strip 15) discharge them so that they fall onto an additional rotating disk 8, which then directs these particles into hoppers 11 and 12 through appropriate through openings between ribs 26 connecting the additional disk 8 with the body 50.

In order to prevent the outlet of fine fraction particles upward and following the coarse particles, the space in front of the flat brush 17 and above it is surrounded by shell or powder concentrator 21 with a lid 25.

The powder particles that have passed through the gap 23 become concentrated in the zone 24 (e.g., the brush 17 causes the particles to quickly build up inside shell 21). Thereafter, they travel downwards inside zone 24 and inwards in the direction of the center of the separator, and eventually fall down onto the additional disk 8.

Figure 10A:
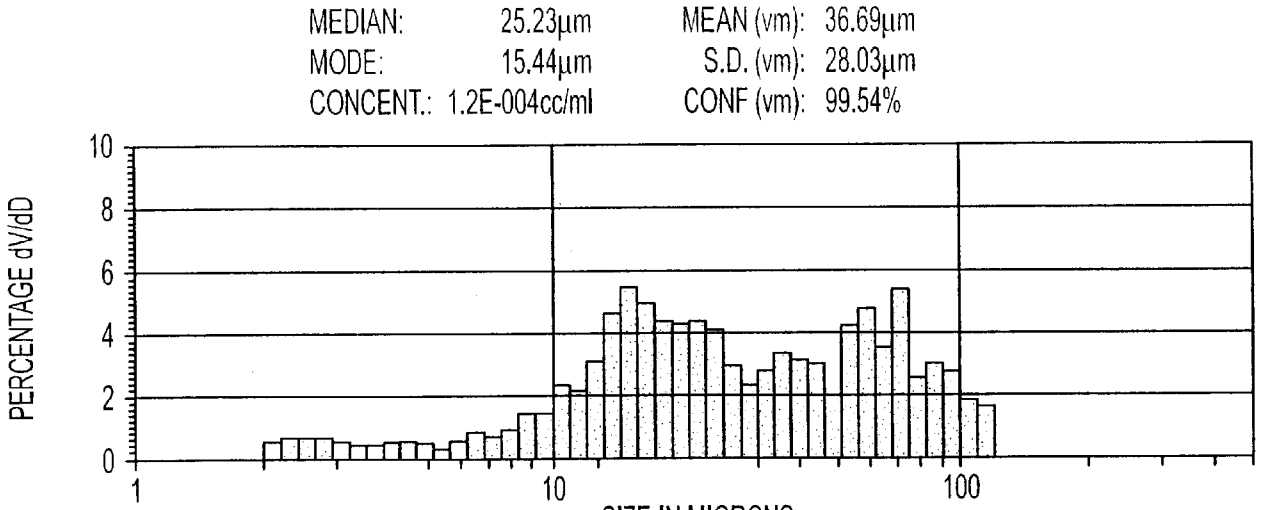
FIG. 10*a* shows a graphite powder distribution in particle size before the separation.
Figure 10B:
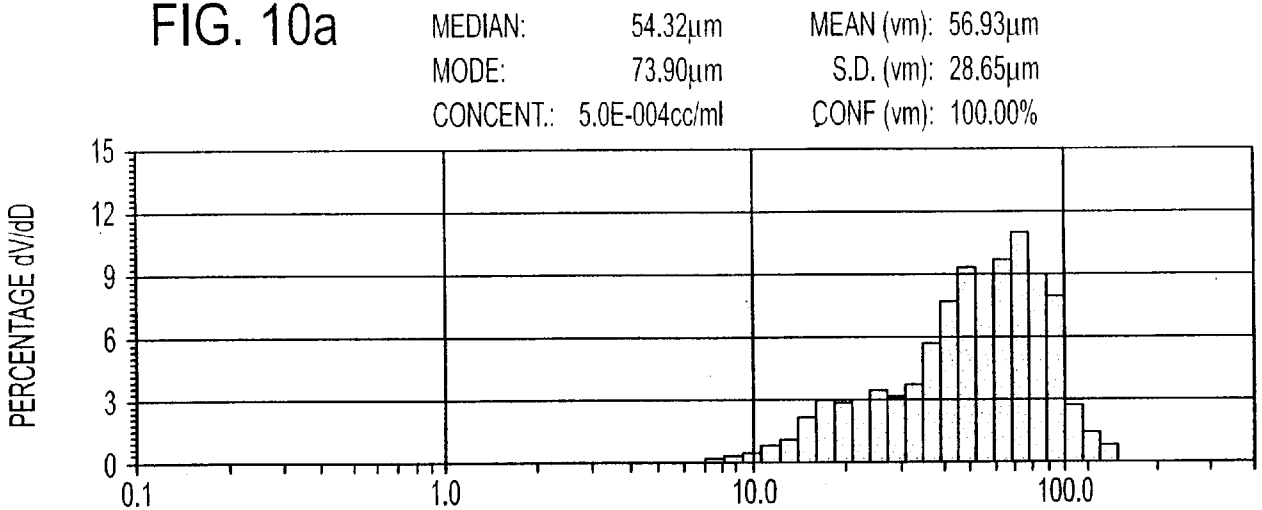
FIG. 10*b* shows a graphite powder distribution in particle size coarse fraction after separation with particle diameter $di \geqq 10\ \mu m$.

Good results have been obtained with a discharge zone 58 length of approximately 150 mm. With half of the circumference length of the upper edge 2 of the surface 1 being 1,570 mm, and with the length of the separation zone 56 being approximately 1,200 mm. For example, the results of graphite and fly ash powders separation carried out on a separator similar to that presented in FIGS. 4*a–b* are given in FIGS. 10*a–b* and 11*a–b,* respectively. Thus in referring to these figures, consider the following information:

In FIGS. 10*a–b,* for graphite, the speed or velocity of surface 1 measured at edge 2 is V=13 m/s, the bowl diameter at edge 2 is D=0.4 m, the angle of surface 1 to the vertical axis is $\alpha$=40°, the friction coefficient of surface 1 is 0.5–0.8; Thus in FIGS. 10*a–b,* the results were obtained for graphite powder with the intention of removing a fraction or particle type having a particle size below 10 $\mu$m. FIG. 10*a* shows a size distribution of graphite particles in the initial powder prior to separation. FIG. 10*b* shows a size distribution of particles in the coarse fraction after the separation according to the criterion $d \geqq$ approximate 10 $\mu$m. The device has the capacity of producing 150 Kg per hour of coarse particles. Moreover, the device can separate 2–8 tons per hour of either graphite or fly ash subject to bowl diameter.

Figure 11A:
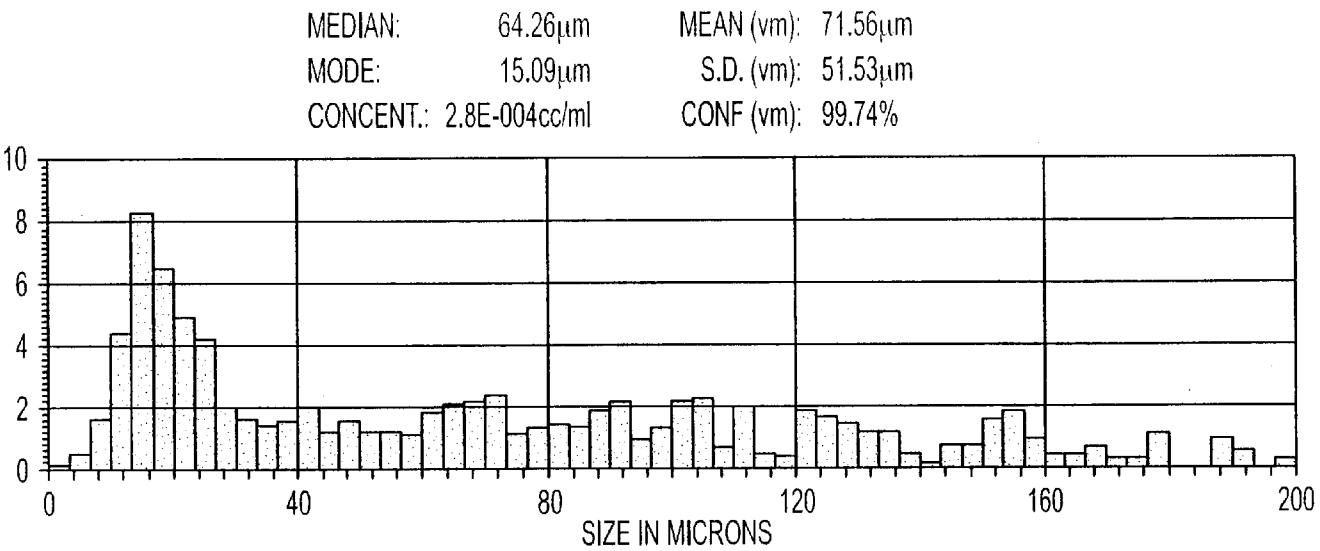
FIG. 11*a* shows a fly ash powder distribution in particle size before the separation.
Figure 11B:
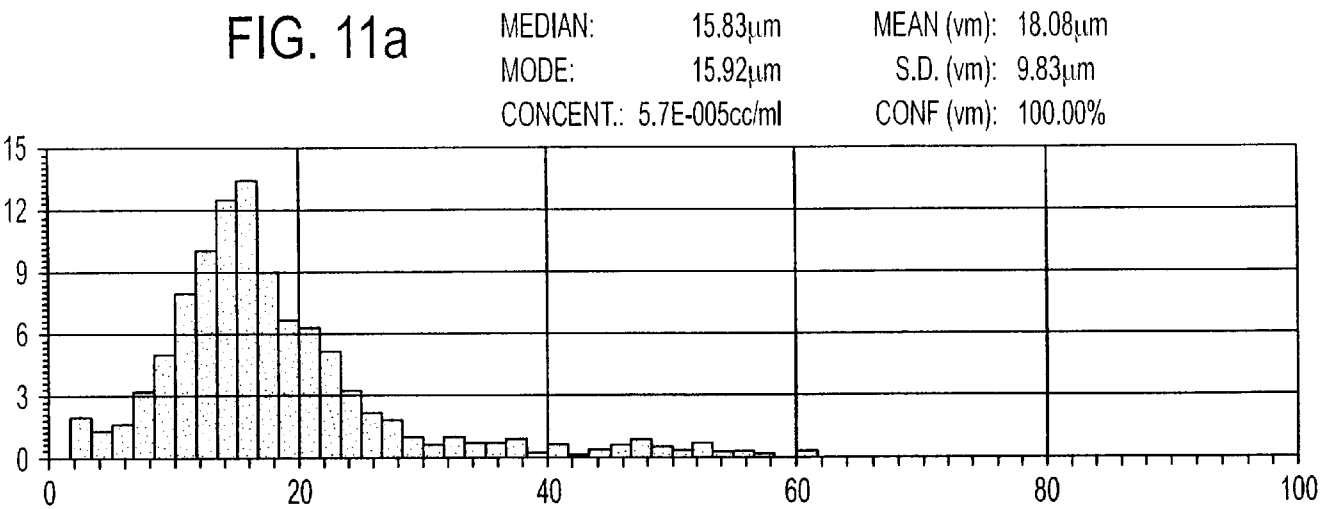
FIG. 11*b* shows a fly ash powder distribution in particle size fine fraction after separation with particle diameter $di \leqq 40\ \mu m$.

In FIGS. 11*a–b,* for fly ash, the sped or velocity of surface 1 measured at edge 2 is V=15 m/s, the bowl diameter at edge 2 is D=0.4 m, the angle of surface 1 to the vertical axis is $\alpha$=40°, the friction coefficient of surface 1 is 0.6–1.0; Thus in the case of fly ash powder, the initial powder was successfully separated into two fractions, i.e., one with $di \geqq$ approximately 40 $\mu$m and $di \leqq$ approximately 40 $\mu$m (wherein d=40 $\mu$m is the separation criteria which is in the domain of the largest particle diameters of the fine fraction and in the domain of the smallest particle diameters of the coarse fraction). FIG. 11*a* shows a size distribution of particles in the initial powder and FIG. 10*b* shows a size distribution of particles in the fine fraction. The process efficiency was about 2 tons per hour.

Figure 6A:
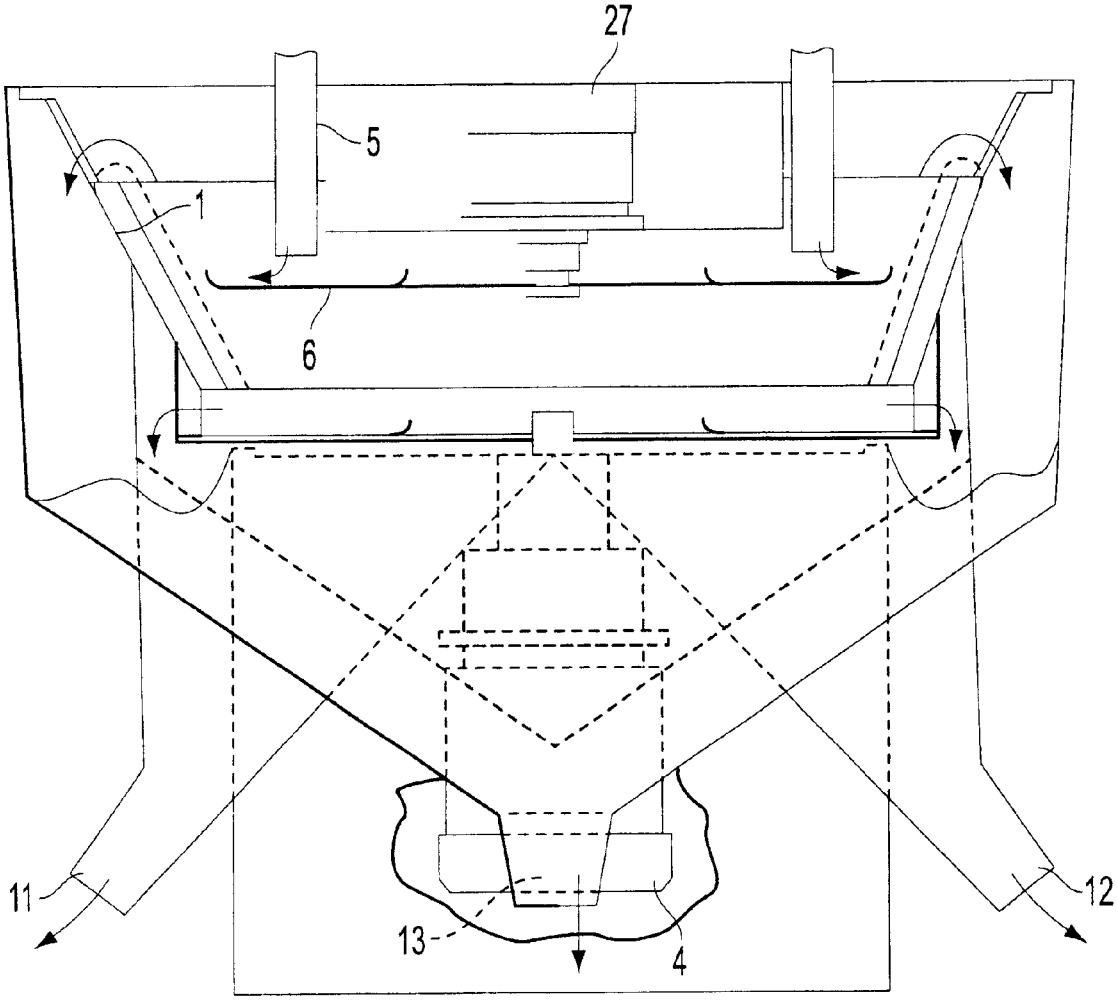
FIG. 6*a* shows a side view of another embodiment of a separator for dry separation of powders which utilizes separate drive of the feeder disk.

FIG. 6*a* shows another embodiment of the separator. In this embodiment, the disk 6 utilizes an independent drive 27 which is located above the disk 6. This design allows independent and precise control of the rotation rate of the feeding disk 6. Thus the surface 1 is rotated with bottom drive 4 while the disk 6 is independently rotated by top drive 27.

Figure 6B:
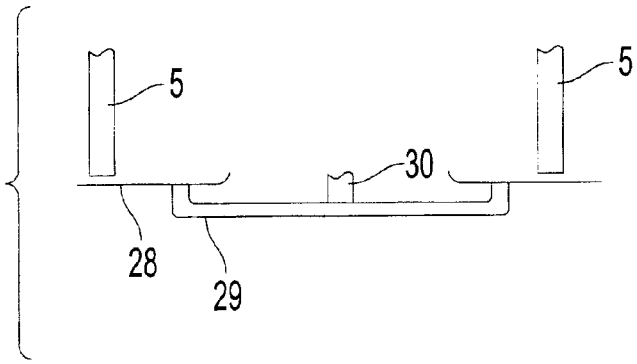
FIG. 6*b* shows a side view of one of many possible disk embodiments which utilizes a feeder in the form of a rotating ring.

FIG. 6*b* shows another embodiment of the invention, which provides for the use of a ring 28 in place of the feeding disk 6. In this design, allows for a decrease in the mass of the rotating parts. As can be seen from the previous embodiments, disk 6 has a diameter which extends across almost to surface 1. As a result of this size, the disk has to have sufficient thickness to withstand significant deflection due to gravity and the force of the particles which contact it after leaving feeding pipe 5. This thickness, of course, increases the mass of the disk 6 which places a greater load on the drive 4 and/or 27. However, the design shown in FIG. 6*b* allows the disk mass to be reduced. That is, the disk 6 can be substituted with ring 28, which is fastened to the axle 30 (axle can be driven from a top drive as shown in FIG. 6*a* or from a bottom drive as shown in FIG. 4*a*). Between the axle and the ring 28 are a plurality of connecting spokes or ribs 29, their size and quality being sufficient to withstand significant deflection so that the ring 28 remains essentially perpendicular to a center axis of the rotating surface 1.

Figure 7:
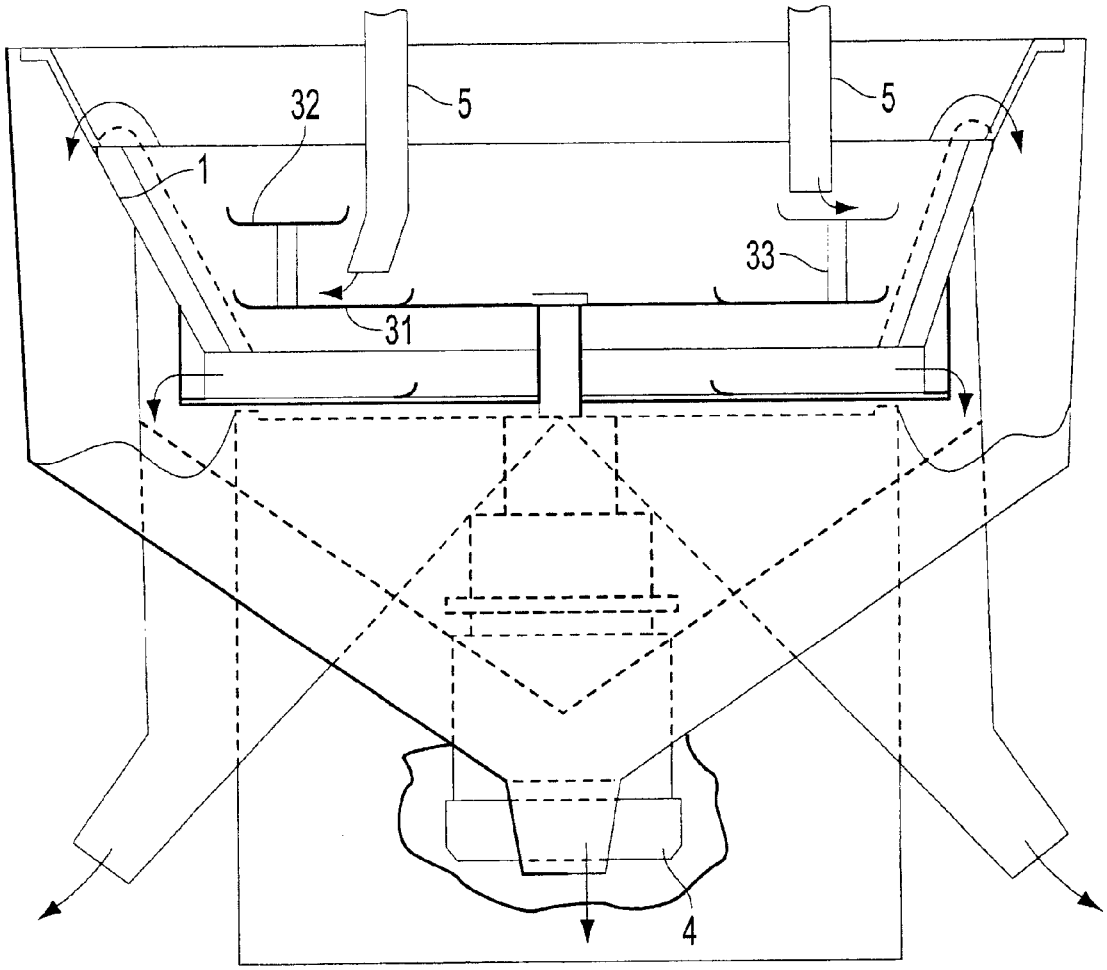
FIG. 7 shows a side view of another embodiment of a separator for dry separation of powders utilizing feeding disks (rings) arranged at various levels.

FIG. 7 shows still another embodiment of a disk design. Here disk 31 includes a ring 32 which is arranged above the disk 31. In this design each of the two feeding pipes 5 direct the powder to either disk 31 or ring 32. As can be seen from the drawing, ring 32 is supported above disk 31 by a plurality of support posts 33. This design allows powder exiting from feeding pipe 5 on the right to be feed to a higher section of surface 1 sing the powder from this pipe is directed only onto ring 32. Feeding pipe 5' on the left directs the powder only onto disk 31 which feeds the powder to a lower section of surface 1.

In operation, powder is fed onto the periphery of the disk 31 by a pipe 5' with a curved end. Simultaneously, more powder is fed to the ring 32 from a straight pipe 5. In this embodiment, the feeding zone of surface 1 into which powder 22 is thrown from the disk 31 is located below the feeding zone into which powder 22 is thrown from the ring 32. As these sections of the surface 1 have different heights and therefore different linear velocities, the separation conditions for powders thrown from the disk 31 and the ring 32 are different. This makes it possible to improve the separation quality if, for instance, one of fractions obtained after the separation of powder thrown by the disk 31 is used as an initial material fed to the ring 32 for another separation at a higher linear velocity. Such a system of arranging the disk 31 and the ring 32, can also be used to separate a powder into a large number of fractions, or alternatively, for the separation of two different powder types.

Moreover, the rotation axis of the feeding system disk need not coincide with the rotation axis of the surface 1. Thus the invention contemplates another embodiment in which one, two, or several feeding disks 34, each having its own drive 35, can be arranged along the surface 1. In this design, driving the one or more disks from above is preferred.

Figure 8A:
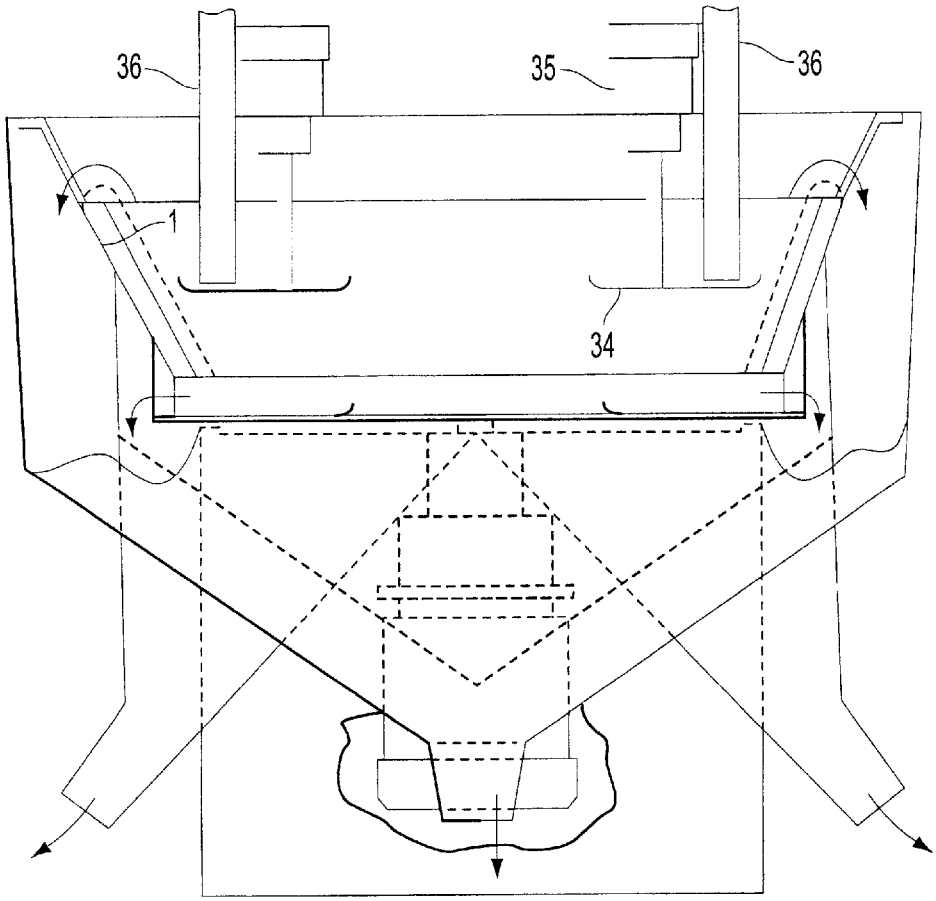
FIG. 8*a* shows a side view of another embodiment of a separator for dry separation of powders in which the feeding disks are arranged on an axes which do not coincide with the surface of rotation axis.

FIG. 8*a* shows an embodiment of the separator with two such disks 34. Each disk 34 rotates about a shaft or axle via independent drives 35. Again, as with the previous embodiments, these drives should be separately controllable for speed. Moreover, as can be seen from the figure, each is position with respect to feeding pipe 36. Preferably, each disk 34 is also made adjustable not only as to its speed but also as to its vertical position as will be more specifically described herein.

Figure 8B:
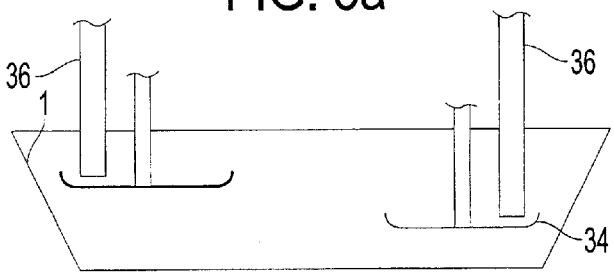
FIG. 8*b* shows a side view of one of many possible disk embodiments with feeding disks arranged at various levels.
Figure 8C:
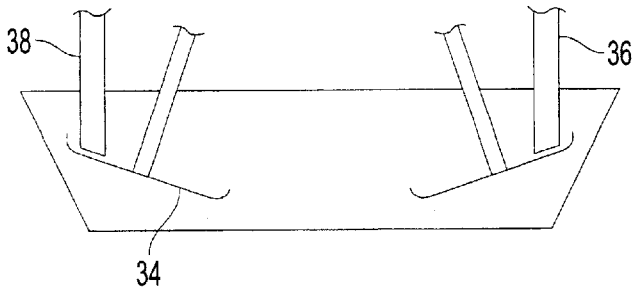
FIG. 8*c* shows a side view of one of many possible disk embodiments with the axes of feeding disks arranged at an angle to the axis of the surface of revolution.

Depending on the technological process requirements, such disks can be arranged at various heights as shown in FIG. 8*b*. Additionally, and/or alternatively these disks 34 may also be adjustably arranged at various angles, such as from approximately 45° to 90°, to the rotation axis of the surface 1. Moreover, the powder feeding pipe 36 should be positioned adjacent the periphery of each disk 34 from the side nearest to the surface 1. In yet another embodiment, this design may also utilize the ring design of FIG. 6*b* in place of one or more disks 34.

Figure 9A:
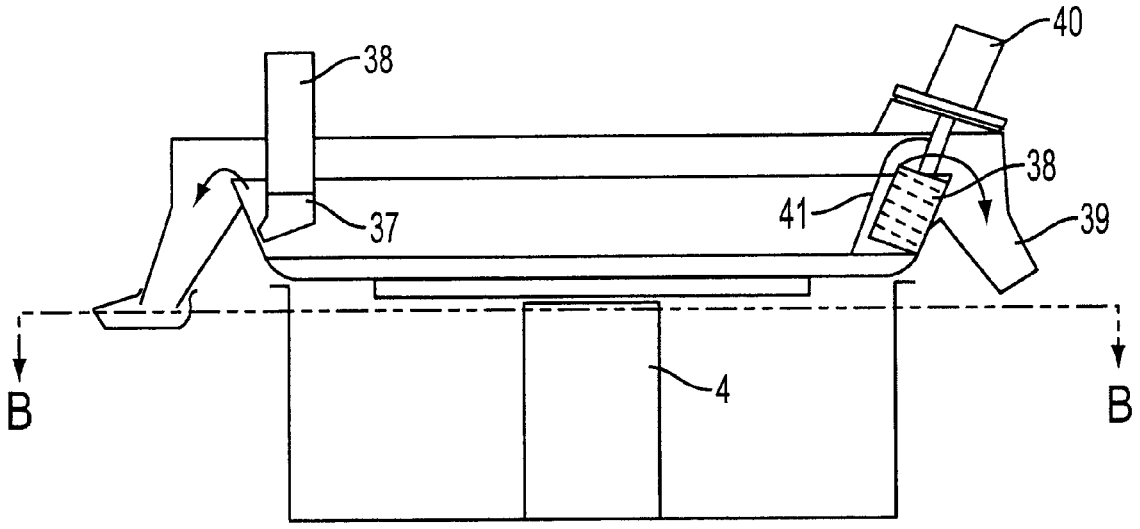
FIG. 9*a* shows a side view of another embodiment of a separator for dry separation of powders with feeding by a nozzle and discharge using a rotating brush.
Figure 9B:
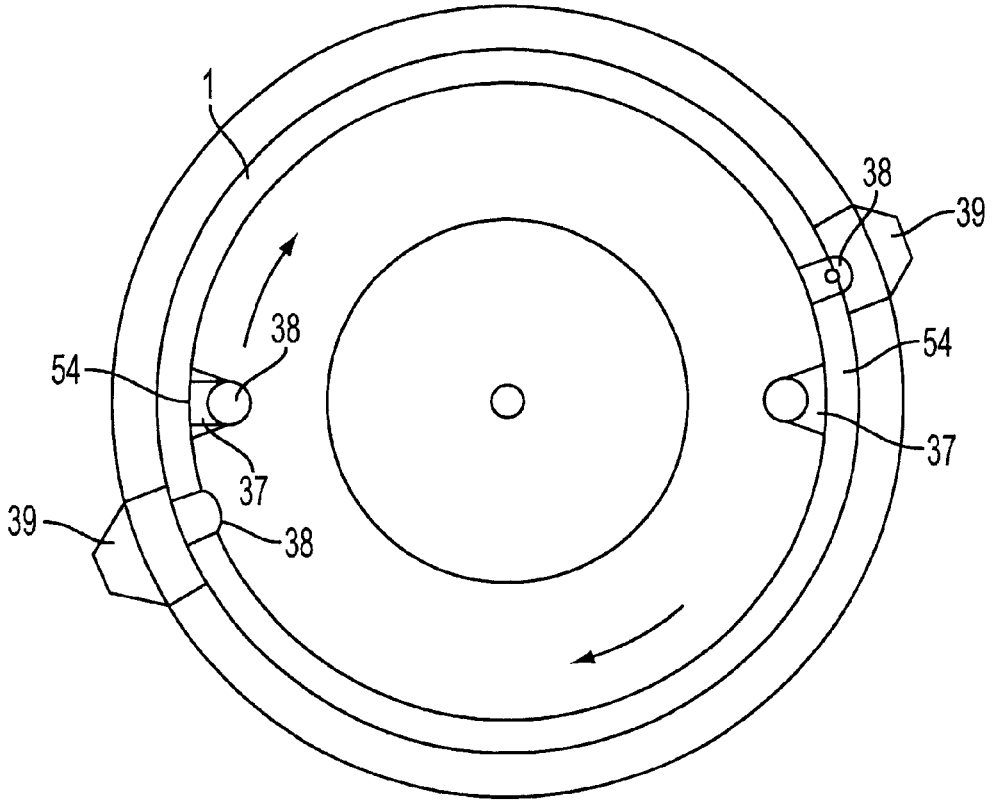
FIG. 9*b* shows a top view of the embodiment shown in FIG. 9*a;*

FIGS. 9*a–b* show yet another separator embodiment, wherein the feeding system is in the form of a power feeding pipe 38 having a powder directing nozzle 37. In this design, the powder enters the feeding zone 54 directly from the nozzle 37. Although only one pipe 38 is shown in FIG. 9*a*, FIG. 9*b* illustrates that more than one pipe may be utilized. For example, in this embodiment, two feeding pipes 38 with nozzles 37 are oppositely arranged along the surface 1. Also, In this embodiment, the discharge devices 7 are replaced by cylindrical brushes 38 rotating around their axes via drives 40. Each of the brushes 38 again has an independent drive 40 which is separately controllable and movingly adjustable. The brush 38 is preferably adjustably mounted at an angle of approximately 20° to the generatrix of the surface of revolution and functions to remove particles of the fine fraction upwards, to the hopper 39. Preferably, the brush 38 is mounted at the same angle to the generatrix of the surface of revolution sloping to the opposite side. Alternatively, the rotation direction of the brush 38 can also be made opposite to the rotation direction of surface 1, so that it will discharge fine fraction particles downwards to the additional disk 8 (not shown).

Preferably, the cylindrical brush 38 is located inside a shell similar to that shown in FIG. 5*c* which at least partially surrounds the brush and acts as a powder concentrator 41.

Figure 12:
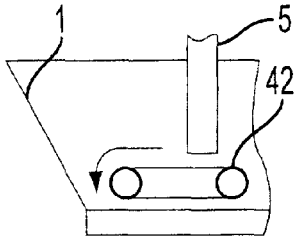
FIG. 12 shows a side view of one of many possible feeding embodiments, here in the form of a feeding conveyer.

FIG. 12 shows still another embodiment of a feeding device in the form of a conveyer 42. In this embodiment, the powder is fed from the pipe 5 onto a conveying surface which moves the powder towards the surface 1. Again, one of more of these device may be employed to deliver powder from each pipe 5 to surface 1. Additionally, the speed and the drive for this conveyor should be separately adjustable and controllable.

Figure 13A:
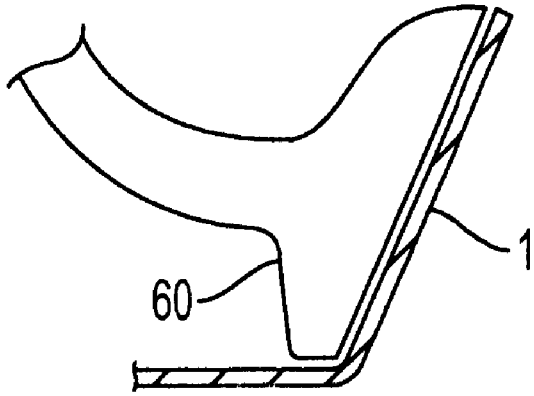
FIG. 13*a* shows a side view of still another embodiment of a discharge device in the form of a pipe with a suction nozzle at the end.
Figure 13B:
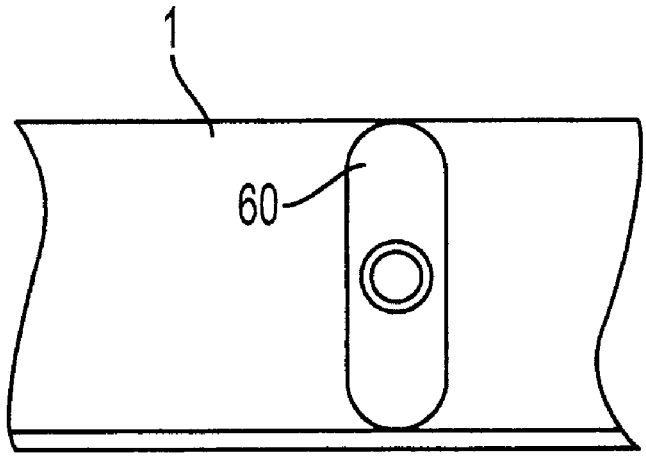
FIG. 13*b* shows a front view of the embodiment shown in FIG. 13*a*.

FIG. 13 shows still another embodiment of a discharge device also can represent a pipe with a suction nozzle 60 at the end, with the nozzle being arranged along the generatrix of the surface of revolution, and rarefaction is created in the pipe and in the nozzle. Air flow sucked in by the nozzle tears powder particles off the cavity surface in the discharge zone and directs them into the nozzle and further, by the pipe, into a hopper.

The operation of the separation will now be described in more detail. The powder separation occurs on a wall of a cavity of a rotating body. The body rotates around a vertical axis and has a centrally symmetrical cavity open from above and from below. The cavity symmetry axis coincides with the body rotation axis, and the cavity surface is a surface of revolution with circular upper and lower edge's of this cavity, the diameter of the upper circumference being greater that the diameter of the lower circumference.

In operation, powder is fed to a certain zone which is called a feeding zone and which is adjacent to the lower portion of the cavity surface. The length of this zone is much less than the length of the separation zone 1s (preferably 5–9 times smaller than 1s).

The length of the separation zone is determined by the relationship $1s \geqq 1g \times V/Vg$, where 1g is the distance between the lower edge of the feeding zone to the upper edge of the cavity surface along the generatrix of the surface of revolution, and V is the linear velocity of the upper edge 2 of cavity surface 1, and Vg is the velocity of the coarse powder fraction motion upwards along the generatrix of the surface of revolution.

The diameter of coarse fraction particles can be determined by $di \geqq d$ where d is the diameter of particles according to which particles are separated into two fractions. It should be noted that use of the term "diameter" as used herein, is not to be construed to limit the invention to spherical particles. Rather, it is used to describe the size of the particles.

Behind the separation zone in the sense of the body rotation, is the discharge zone, where a discharge device facilitates the discharging the powder remaining on the cavity surface. This zone is arranged along the entire generatrix of the surface of revolution.

The separation proceeds as follows: the powder falls on the rotating surface of a cavity having a certain roughness. Since the resultant of all the forces acting on powder particles is different for large size and small size particles, the larger particles move upward and, during the passage of the separation zone form the feeding zone to the discharge zone, pass up over the upper edge of the cavity surface, and thereafter fall into one of hoppers for collection. The smaller particles on the other hand, remain on the cavity surface by virtue of their interaction with the surface until they reach the discharge device, which at this point discharges them into a respective hopper.

Further increase in the efficiency can be achieved by arranging several feeding zones and, respectively, separation zones and discharge zones along the cavity surface. Here one of the fractions obtained in one of separation zones, can be fed to another separation zone, which will improve the separation quality.

The powder can be fed to the feeding zone by an appropriately oriented pipe with a nozzle or by a number or rotating disks or rings, or else by a conveyer. The rotating disks or rings can have a rotation axis which can either coincide with or be different from the cavity rotation axis. Moreover, each of the rotating surface 1 or the disks/rings can be driven by the same drive or have an independent drives. Additionally, these disk may be located in a plane perpendicular to the cavity rotation axis, or in some other plane. These disk may also be located in the same plane or positioned one under another.

In any of these embodiments, powder is fed by a pipe to the periphery of the rotating disk or ring and thrown into the feeding zone under the action of the centrifugal force.

The discharge device represent a flat or round brush adjoining the rotating, cavity surface. The brushes can be adjustably fixed so as to be movable in longitudinal or transverse direction and can be either static or adapted to rotate around their axes. The discharge device can comprise on brush or several brushes located at various distances form one another. The discharge device can represent a flexible elastic strip with one of end faces adjoining the cavity surface. The discharge device also can represent a pipe with a suction nozzle at the end; the nozzle is arranged along the generatrix of the surface of revolution, and rarefaction is created in the pipe and in the nozzle. Air flow sucked in by the nozzle tears powder particles off the cavity surface in the discharge zone and directs them into the nozzle and further, by the pipe, into a hopper.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A system for dry separation of powders into at least two fractions comprising:

a) a hollow body rotatable about a vertical axis of rotation, the hollow body having a cavity defined by a surface having an axis of rotation having a central axis coinciding with the axis of rotation of the hollow body, the surface defining the cavity having an upper edge having a greater diameter than a lower edge of the surface defining the cavity;

b) a system controlling the rotation of the hollow body;

c) at least one feeder constructed and arranged to substantially continuously feed dry powder into a feeding zone adjacent to the cavity surface near its lower edge, the length of the feeding zone being at least an order of magnitude less than the circumference of the cavity surface in its lower portion;

d) at least one of the at least one feeder constructed and arranged to feed the dry powder into the hollow body at a location offset from the hollow body vertical axis of rotation;

e) at least one discharge device constructed and arranged to substantially continuously remove powder from the cavity surface as a result of the cavity surface moving relative to the at least one discharge device;

f) at least two hoppers, one of which is constructed and arranged to receive a powder fraction comprising powder particles passing over the upper edge of the cavity surface in the course of separation, and the second of which is constructed and arranged to receive a powder fraction remaining on the cavity surface essentially until the discharging device removes it from the rotating surface into the second hopper.

2. The system of claim 1, wherein the discharge device comprises an elongated body arranged along a length of the generatrix of the surface defining the cavity and located immediately in front of the feeding zone.

3. A system according to claim 1, wherein the slope of the generatrix of the surface defining the cavity with respect to the vertical within the limits from 10° to 45°, and the roughness of the cavity surface is within 0.01 d to 0.2 d, where d is the diameter of particles, by which the powder is separated into fractions so that particles with diameters $di \leqq d$ are found in one fraction, and particles with diameters $di \geqq d$—in another.

4. A system according to claim 1, wherein n pairs feeder/discharging device are uniformly arranged over the cavity surface so that the following relationship is valid: $L \geqq n(1f+1s+1u)$, where L is the circumference length of the lower edge of the surface, 1f is the feeding zone length, 1s is the separation zone length, 1u is the unloading zone length, the separation zone length being $1s \geqq 1g \times V/Vg$, where 1g is the distance between the lower edge of the feeding zone to the upper edge of the cavity surface, V Is the linear velocity of the upper edge of cavity surface, Vg is the mean velocity of the rise of coarse powder fraction particles along the generatrix of the surface of revolution.

5. A system according to claim 1, wherein at least one of the at least one feeder comprises a rotating disk and a pipe for feeding powder to the disk, the disk being disposed inside the cavity in a plane perpendicular to the rotation axis of the hollow body, and the outlet of the feeding pipe located above the disk on its periphery.

6. A system according to claim 5, wherein disk rotation axis coincides with rotation axis of the surface defining the cavity, and the disk has the same drive as the rotating body.

7. A system according to claim 5, wherein disk rotation axis coincides with surface defining the cavity, and the disk has an independent drive.

8. A system according to claim 5, wherein two or more outlets of feeding pipes are uniformly arranged above a surface of the disk near its periphery along its circumferential length.

9. A system according to claim 1, wherein the feeder comprises a rotating flat ring and a pipe for feeding powder to this ring, the ring being disposed inside the cavity of the rotating body in the plane perpendicular to the rotation axis of the cavity, and the rotation axis of the ring coincides with the rotation axis of the cavity, the outlet of the feeding pipe being located above the plane of the ring.

10. A system according to claim 9, wherein at least two flat rings are located one above another.

11. A system according to claim 9, wherein at least one such flat ring is located above the flat disk.

12. A system according to claim 1, wherein the disk rotation axis does not coincide with the cavity rotation rate, the disk having an independent drive, and there is one outlet of the feeding pipe above its periphery.

13. A system according to claim 12, wherein two or more disks are uniformly arranged along a cavity surface.

14. A system according to claim 13, wherein the disks are arranged at various heights with respect to the lower edge of the cavity surface.

15. A system according to claim 1, wherein the feeder comprises a rotating disk and a pipe for feeding powder to the disk, the disk being disposed inside the cavity of the rotating body, and the rotation axis of the disk does not coincide with the rotation axis of the cavity and is not parallel to it, the angle between the rotation plane of the disk and the rotation axis of the cavity being within the interval from 45° to 90°, and the disk has an independent drive, and the feeding pipe comprises outlet.

16. A system according to claim 15, wherein two or more disks are uniformly arranged along a cavity surface.

17. A system according to claim 1, wherein the feeder comprises feeding pipe with an outlet fitted with a nozzle feeding powder to the feeding zone.

18. A system according to claim 16, wherein two or more nozzles are uniformly arranged along the cavity surface.

19. A system according to claim 1, wherein the feeder comprises a feeding pipe and a conveyer arranged in the cavity of the rotating body so that the powder on the conveyer moves along the straight line connecting the rotation axis of the rotating body with the cavity surface, and the outlet of the feeding pipe is located above the conveyer near its end which is nearer to the rotation axis.

20. A system according to claim 19, wherein powder moves in a plane of powder motion on the conveyor is perpendicular to the rotation axis of the cavity.

21. A system according to claim 19, wherein the angle between the plane of powder motion on the conveyer and the axis of rotation of the cavity is within a range from about 45° to about 90°.

22. A system according to claim 1, wherein a space in front of the discharge device with respect to a direction of relative rotation is surrounded substantially along the entire length of the discharge device by a shell-powder concentrator, which does not adjoin the cavity surface.

23. A system according to claim 1, wherein the discharge device comprises at least one flexible elastic strip adjoining the cavity surface with the end face of its longer side and arranged along the entire length of the generatrix of the surface of revolution at an angle from about 0° to about 30° with respect to the surface of revolution.

24. A system according to claim 1, wherein the discharge device comprises at least one flat brush arranged along the entire length of the generatrix of the surface of revolution at an angle from 0° to 30° to the generatrix.

25. A system according to claim 24, wherein several the brushes are assembled into a battery and arranged parallel to one another with an interval equal or exceeding the width of one brush.

26. A system according to claim 1, wherein the discharge device comprises at least one rotating circular brush having an independent drive and arranged along the entire length of the generatrix of the surface of revolution at an angle to the generatrix.

27. A system according to claim 26, wherein the angle is within the interval from about 0° to ± about 30°.

28. A system according to claim 1, wherein the discharge device comprises member selected from a conveyor, a belt, an apron or flight conveyor or combinations thereof comprising external surfaces of conveying planes in the form of a brush, which is angled along essentially the entire length of the generatrix of the surface of revolution.

29. A system according to claim 1, wherein the separator comprises a rotating disk whose rotating axis coincides with the rotation axis of the surface defining the cavity and which is located under the lower level of the surface of revolution.

30. A system for dry separation of powders into at least two fractions including a powder to be separated and a separator comprising:

a) a hollow body rotatable about a vertical axis, the hollow body having a cavity of open from above and from below and the cavity comprising a surface of revolution having a central axis coinciding with the rotation axis of the body, the upper edge of the cavity having a gate diameter than its lower edge;

b) a system rotating the body;

c) at least one feeder continuously feeding dry powder into a feeding zone adjacent to the cavity surface near its lower edge, the length of the zone being at least an order of magnitude less than a circumference of the cavity surface in its lower portion;

d) at least one discharge device constructed and arranged to essentially continuously remove powder from a cavity surface, comprising a suction nozzle arranged along essentially the entire generatrix of the surface of revolution;

e) at least two hoppers, one of which is constructed and arranged to receive a powder fraction comprising powder particles passing over the upper edge of the cavity surface in the core of separation, and the second is intended for powder fraction remaining on the cavity surface until being suctioned by the nozzle.

31. A system for dry separation of powders into at least two fractions, the system comprising a powder to be separated and a separator comprising:

a hollow body rotating about an axis and defining a cavity having a powder engaging surface, the powder engaging surface being a surface of revolution which rotates about the axis, an upper edge of the cavity having a greater diameter than a lower edge;

a system controlling the rotation of the body;

at least one feeder continuously feeding dry powder into a feeding zone adjacent to the cavity surface near the lower edge of the cavity surface, the length of the feeding zone being at least an order of magnitude less than a circumference of the cavity surface of the lower edge;

at least one of the at least one feeder constructed and arranged to feed the dry powder into the hollow body at a location offset from the axis;

at least one discharge device continuously discharging the powder from the cavity surface, the at least one discharge device comprising a body arranged along substantially the entire length of the generatrix of the cavity surface and located immediately in front of the feeding zone aligned with the rotation of the cavity surface, the at least one discharge device constructed and arranged to discharge the powder from the cavity surface a result of the cavity surface moving relative to the at least one discharge device;

a first hopper for collecting a powder fraction consisting of powder particles passing over the upper edge of the cavity surface;

a second hopper for collecting a powder fraction remaining on the cavity surface until the discharge device discharges the remaining powder fraction from the rotating cavity surface into the second hopper.

* * * * *